US011274482B2

(12) United States Patent
Rupp et al.

(10) Patent No.: US 11,274,482 B2
(45) Date of Patent: Mar. 15, 2022

(54) GUIDE SYSTEM FOR FURNITURE PARTS

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT); Franz Kohlweiss, Hard (AT)

(73) Assignee: Julius Blum GmbH, Hoechst (AT)

( * ) Notice: Subject to any disclaimer, the term of this patent is extended or adjusted under 35 U.S.C. 154(b) by 237 days.

(21) Appl. No.: 16/432,405

(22) Filed: Jun. 5, 2019

(65) Prior Publication Data

US 2019/0284859 A1 Sep. 19, 2019

Related U.S. Application Data

(63) Continuation of application No. PCT/AT2018/060002, filed on Jan. 8, 2018.

(30) Foreign Application Priority Data

Jan. 13, 2017 (AT) ..... A 50023/2017

(51) Int. Cl.
*E05D 15/26* (2006.01)
*E05F 3/20* (2006.01)
*E05D 15/58* (2006.01)

(52) U.S. Cl.
CPC ..... *E05D 15/264* (2013.01); *E05D 15/58* (2013.01); *E05F 3/20* (2013.01); *E05Y 2900/20* (2013.01); *E05Y 2900/212* (2013.01)

(58) Field of Classification Search
CPC . E05D 15/58; E05D 15/264; E05Y 2900/212; E05Y 2900/20; E06B 3/5045
See application file for complete search history.

(56) References Cited

U.S. PATENT DOCUMENTS 2,669,499 A * 2/1954 Vanderplank ..... E05D 15/58 312/322
2,936,206 A * 5/1960 Wilmer ..... E06B 3/5045 312/322

(Continued)

FOREIGN PATENT DOCUMENTS

CN 101490355 7/2009
CN 204552402 8/2015

(Continued)

OTHER PUBLICATIONS

Search Report dated May 26, 2020 in Chinese Patent Application No. 20188006722.4.

(Continued)

*Primary Examiner* — Victor D Batson
*Assistant Examiner* — Matthew J Sullivan
(74) *Attorney, Agent, or Firm* — Wenderoth, Lind & Ponack, L.L.P.

(57) ABSTRACT

A guide system includes a first and second guide rail for guiding furniture parts. The second guide rail, in the mounted position, extends transversely relative to the first guide rail. A guiding device is connected to the first furniture part, and is movable relative to the first and second guide rails and has a fitting portion for fastening to the first furniture part. A carrier is displaceable relative to the second guide rail and is connected to a second fitting portion for fastening to the second furniture part. A first drive device moves the guiding device, starting from the second guide rail, at least over a region in a direction towards the first guide rail. The guide system has a second drive device for moving the guiding device, starting from the first guide rail, into a position in which the first and second fitting portion are aligned.

10 Claims, 18 Drawing Sheets

(56) References Cited

U.S. PATENT DOCUMENTS

| | | | | |
|---|---|---|---|---|
| 3,456,995 | A * | 7/1969 | Nyquist | E05D 15/58 312/322 |
| RE28,994 | E * | 10/1976 | Aylworth | E06B 3/5045 312/245 |
| 4,729,612 | A * | 3/1988 | Stone | E05D 15/58 312/109 |
| 7,987,555 | B2 * | 8/2011 | Chen | E05F 5/02 16/286 |
| 8,231,187 | B2 * | 7/2012 | Hoffman | E05D 15/58 312/322 |
| 8,303,056 | B2 | 11/2012 | Giorgi | |
| 8,484,895 | B2 * | 7/2013 | Kuhnmuench | E05D 15/581 49/164 |
| 8,756,865 | B2 * | 6/2014 | Nicholson | E05D 15/58 49/180 |
| 9,068,386 | B2 | 6/2015 | Ishii et al. | |
| 9,353,562 | B2 | 5/2016 | Oshima et al. | |
| 10,227,806 | B2 * | 3/2019 | Gabl | E05D 15/58 |
| 10,676,974 | B2 * | 6/2020 | Wojdyla | E05D 15/58 |
| 10,876,340 | B2 * | 12/2020 | Rupp | E05D 15/58 |
| 2010/0117500 | A1 | 5/2010 | Giorgi | |
| 2015/0008811 | A1 | 1/2015 | Ishii et al. | |
| 2015/0240546 | A1 | 8/2015 | Oshima et al. | |
| 2015/0300075 | A1 * | 10/2015 | Lyons | E06B 3/509 312/311 |
| 2017/0241178 | A1 | 8/2017 | Gabl | |
| 2017/0260789 | A1 * | 9/2017 | Gabl | E06B 3/509 |
| 2019/0284859 | A1 * | 9/2019 | Rupp | E05D 15/264 |
| 2019/0301216 | A1 * | 10/2019 | Rupp | E05F 1/08 |
| 2019/0301218 | A1 * | 10/2019 | Rupp | E05F 1/08 |
| 2019/0330897 | A1 * | 10/2019 | Rupp | E05D 15/58 |
| 2019/0330898 | A1 * | 10/2019 | Rupp | E05D 15/0665 |
| 2020/0018106 | A1 * | 1/2020 | Rupp | E05D 15/0634 |
| 2020/0018107 | A1 * | 1/2020 | Rupp | E05F 3/14 |
| 2020/0018108 | A1 * | 1/2020 | Sperger | E05D 15/58 |
| 2020/0048946 | A1 * | 2/2020 | Blum | E05D 15/26 |
| 2020/0048947 | A1 * | 2/2020 | Blum | E06B 3/5045 |
| 2020/0063480 | A1 * | 2/2020 | Gasser | E05D 7/0423 |
| 2020/0063482 | A1 * | 2/2020 | Kohlweiss | E05F 1/1253 |
| 2020/0199925 | A1 * | 6/2020 | Vander Bent, Jr. | E05D 15/36 |
| 2020/0217124 | A1 * | 7/2020 | Bernhagen | E05D 15/58 |
| 2020/0347656 | A1 * | 11/2020 | Groninga | B64C 27/04 |
| 2020/0386028 | A1 * | 12/2020 | Girotto | E05F 5/003 |

FOREIGN PATENT DOCUMENTS

| | | |
|---|---|---|
| DE | 298 09 193 | 10/1998 |
| EP | 0 300 270 | 1/1993 |
| EP | 2 924 215 | 9/2015 |
| JP | 4142860 | 6/2008 |
| JP | WO2013/114730 | 8/2013 |
| JP | WO2014/050749 | 4/2014 |
| TW | M533117 | 12/2016 |
| WO | 2007/148366 | 12/2007 |
| WO | 2016/081961 | 6/2016 |
| WO | 2016/081963 | 6/2016 |

OTHER PUBLICATIONS

International Search Report dated Mar. 21, 2018 in International (PCT) Application No. PCT/AT2018/060002.

Search Report dated Dec. 20, 2018 in Taiwanese Patent Application No. 107101178.

* cited by examiner

GUIDE SYSTEM FOR FURNITURE PARTS

BACKGROUND OF THE INVENTION

The present invention relates to a guide system for guiding a movably-supported first furniture part, in particular a first door wing of a folding door, which is hingedly connected to at least one second furniture part, in particular a second door wing of a folding door, the guide system comprising:

- a first guide rail for guiding the furniture parts,
- a second guide rail for guiding the furniture parts, wherein the second guide rail, in the mounted position, extends transversely relative to the first guide rail,
- a guiding device which is to be connected to the first furniture part, which is movable relative to the first and second guide rail and which has at least one fitting portion for fastening to the first furniture part,
- a carrier configured to be displaceable relative to the second guide rail and which is connected to at least one second fitting portion for fastening to the second furniture part,
- a first drive device for moving the guiding device, starting from the second guide rail, at least over a region in a direction towards the first guide rail.

The invention further concerns an arrangement comprising two furniture parts hingedly connected to one another, in particular door wings of a folding door, and a guide system of the type to be described. The invention further relates to an item of furniture having such an arrangement or having such a guide system.

WO 2016/081961 A1 and WO 2016/081963 A1 show mechanical drive devices for folding-sliding doors, in which the folding-sliding door can be moved, starting from a lateral compartment in which the door wings adopt a folded together position to one another, into a position outside of the compartment in which the door wings can be spreaded apart relative to one another. A drawback is the fact that the door wings, after the spreading apart operation, are located in an undefined intermediate position.

It is an object of the present invention to propose a guide system mentioned in the introductory part, having a more convenient operating possibility.

SUMMARY OF THE INVENTION

According to the invention, the guide system includes at least one second drive device for moving the guiding device, starting from the first guide rail, into a position in which the first fitting portion and the second fitting portion are aligned to each other such that the furniture parts, which are connected to the fitting portions in the mounting condition, are aligned substantially coplanar to each other.

By the proposed guide system, it is possible that the furniture parts, in the mounted condition, can be moved from a first position, in which the furniture parts are aligned parallel to one another, into a second position in which the furniture parts are aligned substantially coplanar to one another. By the second drive device, the furniture parts, in the mounted condition, are thus movable into a defined end position, namely in that position in which the furniture parts are aligned substantially coplanar to one another.

It is thereby preferable that the drive devices provided for moving the furniture parts operate exclusively mechanically, i.e. without an electric drive and without further electrical components.

BRIEF DESCRIPTION OF THE DRAWINGS

Further details and advantages of the present invention will be explained with the aid of the following description of figures, in which.

DETAILED DESCRIPTION OF THE INVENTION

Figure 1A:
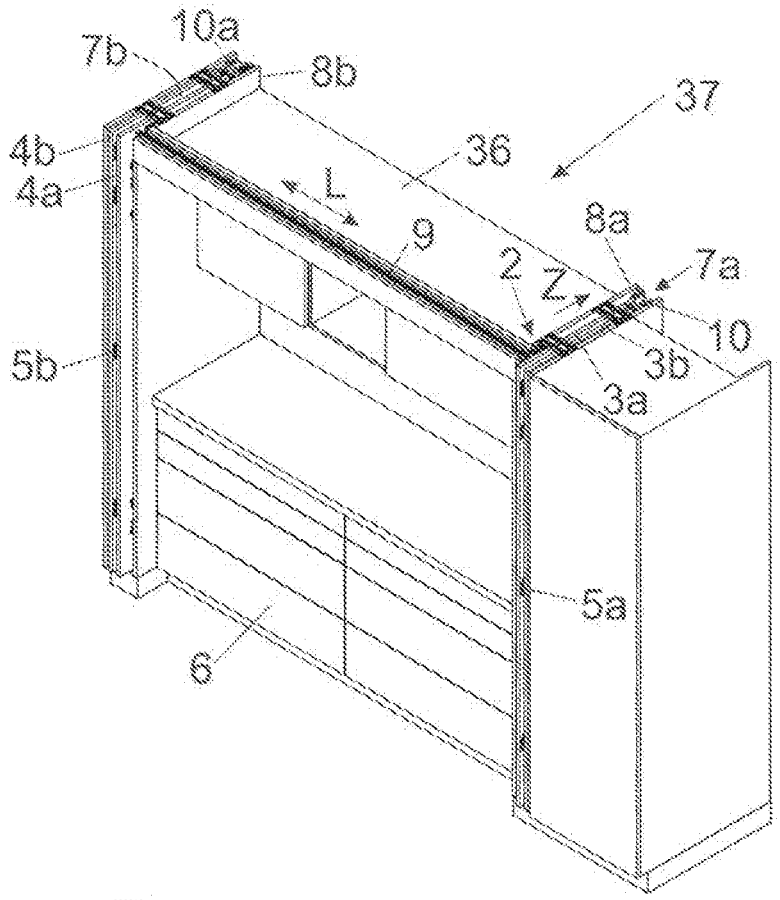
FIG. 1*a*, 1*b* show an item of furniture with a guide system for driving furniture parts which, on the one hand, are located in a countersunk position within a compartment and, on the other hand, in a moved-out position outside the compartment.

FIG. 1*a* shows a possible application of a guide system 2 for guiding a first furniture part 3*a*, preferably in the form of a first door wing of a folding door, in which the first furniture part 3*a*, in the mounted condition, is hingedly connected via a vertically extending axis 5*a* to a second furniture part 3*b* in the form of a second door wing. Optionally, at least two further furniture parts 4*a*, 4*b* may be provided which are also pivotally connected to one another by a vertically extending axis 5*b*. The furniture parts 3*a*, 3*b* and 4*a*, 4*b* are movably supported by the guide system 2 relative to a furniture carcass 36 of an item of furniture 37, and the furniture carcass 36 is stationary during operation. The guide system 2 may be used, for example, as a room partitioning system, so that in a living area, a furniture carcass 6 as shown in FIG. 1*a* in the form of a kitchen block, an office niche, a storage room, a shelf, etc. may entirely be covered by the furniture parts 3*a*, 3*b*; 4*a*, 4*b* and can be optically separated from the remaining space of the living area. The guide system 2 may also be used for cabinet systems, for example a walk-in closet. The functionality will be explained in the following with the aid of the furniture parts 3*a* and 3*b*, and the same applies to the furniture parts 4*a*, 4*b*.

The furniture parts 3*a*, 3*b* are movably supported by the guide system 2 between a first position, in which the furniture parts 3*a*, 3*b* are aligned substantially parallel to one another (FIG. 1*a*), and a second position, in which the furniture parts 3*a*, 3*b* are aligned substantially coplanar to one another. In the first position, the furniture carcass 6 is freely accessible for a person, and the two furniture parts 3*a*, 3*b* can be accommodated in a space-saving manner within an insertion compartment 7*a* arranged laterally besides the side wall 8*a*. The two other furniture parts 4*a*, 4*b*, in a parallel position to one another, can also be accommodated within a further lateral insertion compartment 7*b*.

The guide system 2 includes a first guide rail 9 with a longitudinal direction (L) for guiding the furniture parts 3*a*, 3*b*. For example, the first guide rail 9 may be fixed to a ceiling of a room, to a wall of a room or also to the stationary furniture carcass 36. The guide system 2 further includes at least one second guide rail 13*a* (not shown here) extending transversely to the longitudinal direction (L) of the first guide rail 9 in the mounted condition and by which the furniture parts 3*a*, 3*b* can be moved in a direction (Z) and in a direction opposite the direction (Z). Moreover, a guiding device 10 (FIG. 2*a*) is provided configured to be connected to the first furniture part 3*a* and configured to be moved relative to the first and second guide rails 9, 13*a*. The two other furniture parts 4*a*, 4*b* are movably supported by a separate guiding device 10*a*. Starting from the position shown in FIG. 1*a*, in which the furniture parts 3*a*, 3*b* adopt a parallel position to one another and are thereby accommodated within the lateral insertion compartment 7*a*, the furniture parts 3*a*, 3*b* can be moved, by a mechanical force application, in a direction (Z) into an overpressing position, whereby a first drive device 12 (not shown here) can be triggered. After the first drive device 12 has been triggered, the furniture parts 3*a*, 3*b* can be moved by the first drive device 12 into the position shown in FIG. 1*b*, in which the furniture parts 3*a*, 3*b* are located outside the insertion compartment 7*a* and still adopt substantially a parallel position to one another. Starting from the position shown in FIG. 1*b*, the two furniture parts 3*a*, 3*b*—if required—can be moved by a spreading device 46 (FIG. 14*a*) from the parallel position to one another into a spreaded-apart position, so that the furniture parts 3*a*, 3*b* adopt an angled position relative to one another.

Figure 1B:
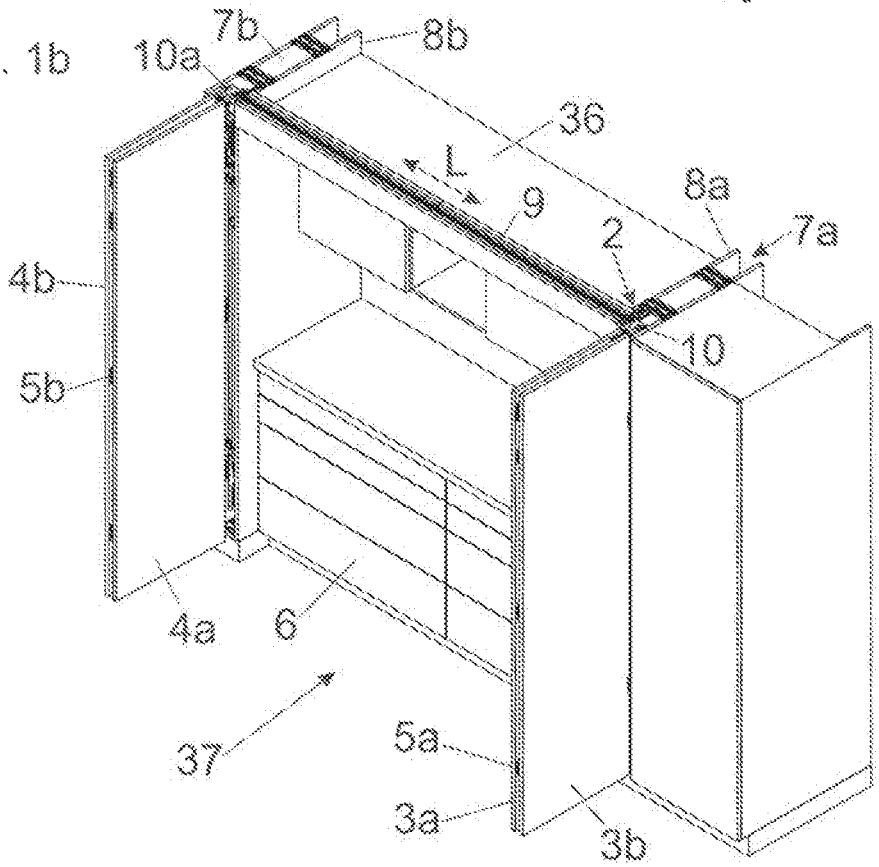
Figure 2A:
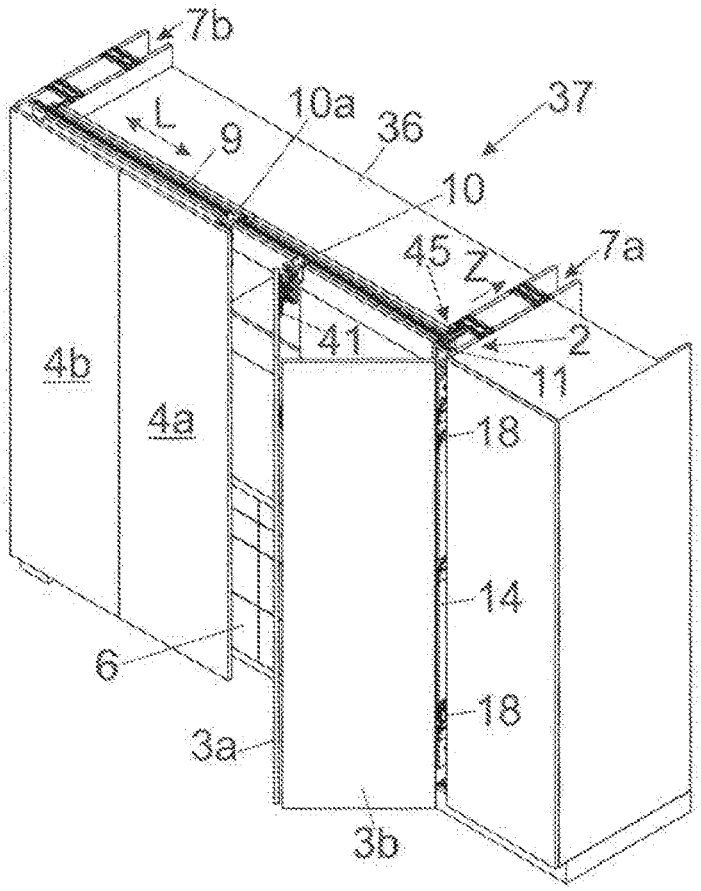
FIG. 2*a*, 2*b* show the item of furniture according to FIG. 1*a*, 1*b* with the furniture parts in two further positions.
Figure 2B:
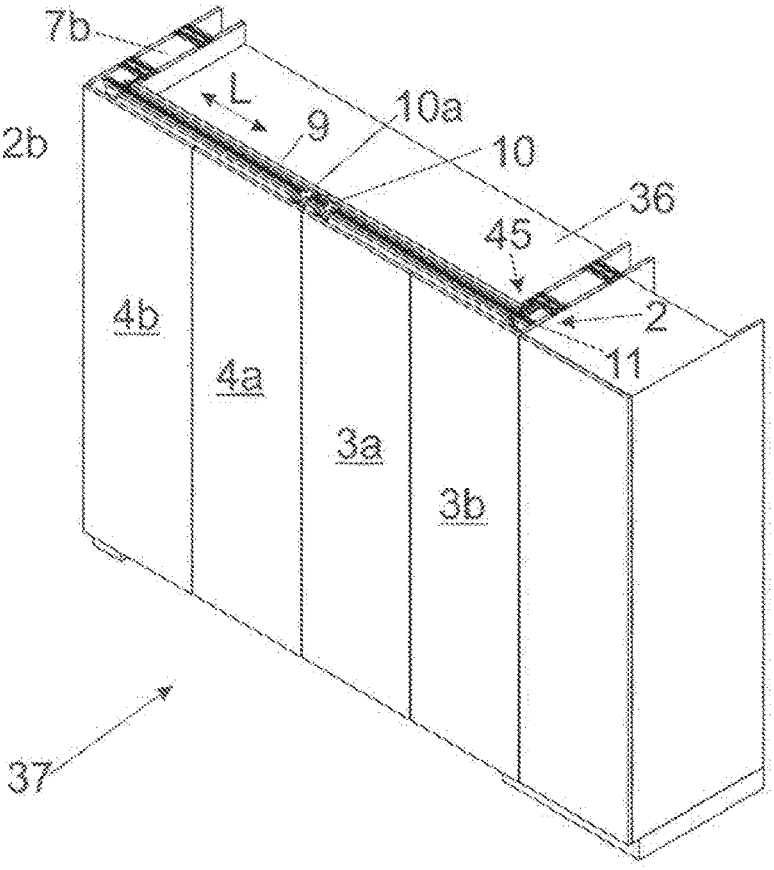

FIG. 2*a* shows, in relation to FIG. 1*b*, a continued movement of the furniture parts 3*a*, 3*b* to one another. The two furniture parts 4*a*, 4*b* have already been moved into a position in which the furniture parts 4*a*, 4*b* are aligned coplanar to one another and thereby cover the furniture carcass 6. The guiding device 10 includes at least one first fitting portion 41 for fixing to the first furniture part 3*a*. The guide system 2 includes a carrier 11 (FIG. 3*b*) which is movably mounted in a direction transverse to the longitudinal direction (L) of the first guide rail 9 and which is connected to at least one second fitting portion 18 for fixing to the second furniture part 3*b*. In the shown embodiment, the carrier 11 is connected to a vertically extending column 14 configured to be moved, together with the carrier 11, in the direction (Z) extending transversely to the longitudinal direction (L) of the first guide rail 9. Two or a plurality of fitting portions 18 may be arranged on the vertical column 14 for the movable support of the second furniture part 3*b*, and the fitting portions 18 are spaced from each other in a height direction of the column 14. The guiding device 10 connected to the first furniture part 3*a* is configured to be transferred in a crossing region 45—seen in a top view onto the first and second guide rails 9, 13*a* in the mounting position—to and from between the first and second guide rail 9, 13*a*. By a second drive device 53 (FIG. 15*a*), the guiding device 10 can be moved starting from the first guide rail 9 in a position in which the first fitting portion 41 of the guiding device 10 and the second fitting portion 18 are aligned such that the furniture parts 3*a*, 3*b*, which are connected to the fitting portions 41, 18 in the mounting condition, are aligned substantially coplanar to each other, as shown in FIG. 2*b*.

Figure 3B:
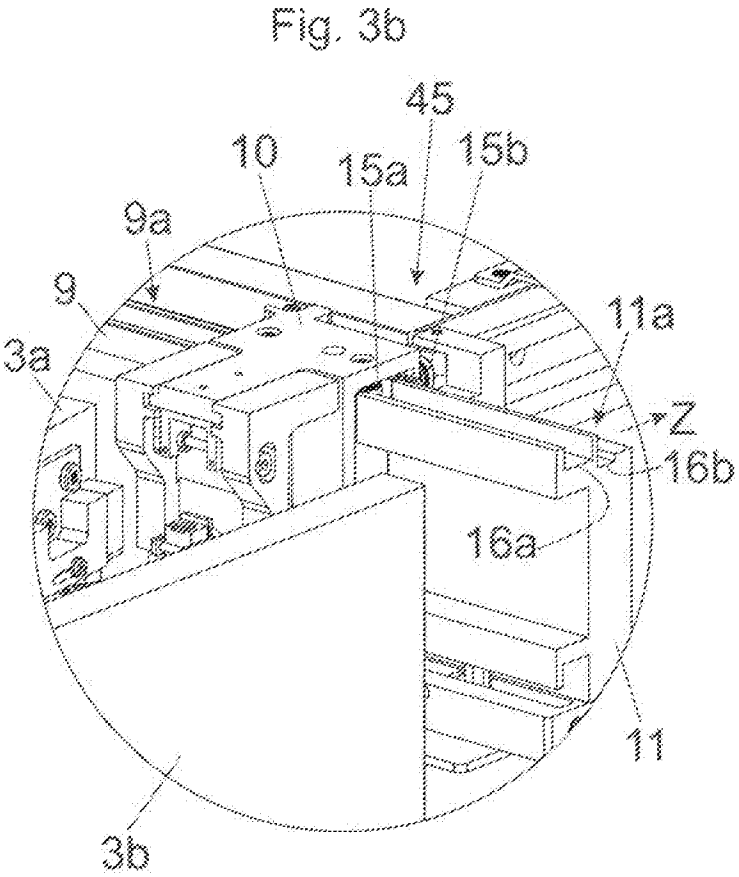
FIG. 3*a*, 3*b* show the item of furniture with the guide system in a perspective view, and an enlarged detail view thereof.
Figure 3A:
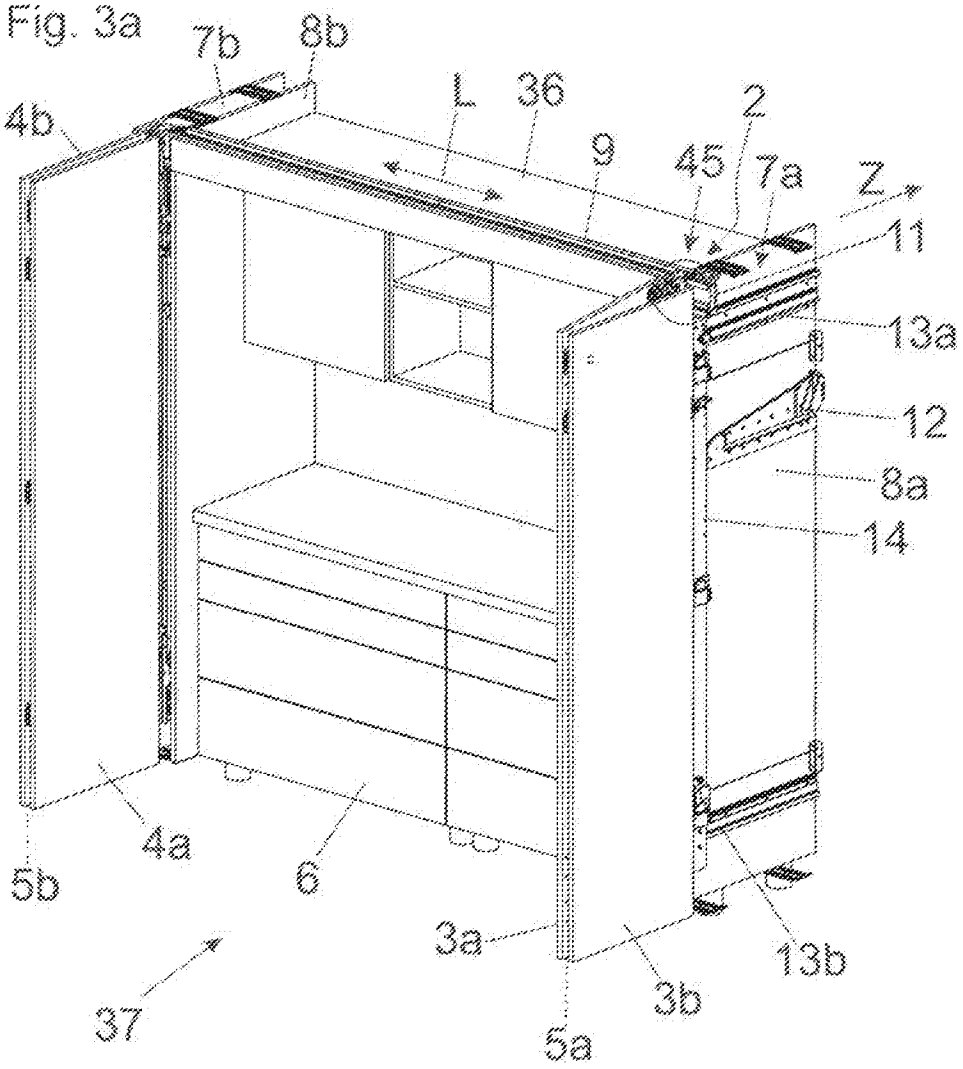

FIG. 3*a* shows the item of furniture 37 in a perspective view, in which the first guide rail 9 and the at least one second guide rail 13*a* for guiding the furniture parts 3*a*, 3*b* are visible. In the shown embodiment, two second guide rails 13*a*, 13*b* are provided which are spaced from each other in a height direction. The carrier 11, together with the column 14 connected thereto, can be moved in the direction (Z) and in a direction opposite the direction (Z). The first guide rail 9 and the second guide rail 13*a* can be configured as separate components which, in the mounted condition, can adopt a same height position or also a different height position. Alternatively, it is also possible that the first guide rail 9 and the second guide rail 13*a* have a one-piece configuration and are connected to one another by a curved portion. The crossing region 45, in a top view, is that region in which the guide rails 9, 13*a* or notional extensions of the guide rails 9, 13*a* intersect with one another. The guide system 2 includes a first drive device 12 for moving the guiding device 10 can be moved, starting from the second guide rail 13*a*, at least over a region in a direction of the first guide rail 9, and/or can be retracted, starting from the crossing region 45, at least over a region along the second guide rail 13*a*.

FIG. 3*b* shows the region encircled in FIG. 3*a* in an enlarged view. The first furniture part 3*a* is connected to a guiding device 10 for moving the furniture parts 3*a*, 3*b* along the first and second guide rails 9, 13*a*. Visible is a carrier 11 configured separate from the first guide rail 9, the carrier 11 being in the form of a displaceable slider which adjoins the first guide rail 9 in a longitudinal direction (L) such that the guiding device 10 connected to the first furniture part 3*a* can be transferred to and from between the first guide rail 9 and the carrier 11. The guiding device 10 can include at least one first running wheel 15*a* having a vertical rotational axis for absorbing lateral forces, and at least one second running wheel 15*b* having a horizontal rotational axis for absorbing vertical forces. The running wheels 15*a*, 15*b* are movably arranged in a profiled section 9*a* of the first guide rail 9, the profiled section 9*a* extending in the longitudinal direction (L). The carrier 11 also includes a profiled section 11*a* with a cross-section corresponding to the form and size of the profiled section 9*a* in cross-sectional view, so that the guiding device 10 can be transferred to and from between the first guide rail 9 and the carrier 11. For example, the carrier 11 can have at least two guide channels 16*a*, 16*b* extending in the longitudinal direction (L) for guiding the running wheels 15*a*, 15*b*.

The guiding device 10 configured to be displaceable along the first guide rail 9, in the shown transfer position of the carrier 11, is still located on the first guide rail 9. The carrier 11, in the transfer position, can be releasably locked to the first guide rail 9, and that locking can be released by a movement of the guiding device 10 in or on the carrier 11. After the carrier 11 has been unlocked, the carrier 11 can be moved—together with the guiding device 10 and the two furniture parts 3*a*, 3*b*—horizontally in the direction (Z) extending transversely, preferably at a right angle, to the longitudinal direction (L) of the first guide rail 9. The carrier 11 is connected to the vertically extending column 14 which is configured to be driven by the first drive device 12 at least over a region in the direction (Z) and/or in a direction opposite the direction (Z). The column 14 is movably supported relative to the second guide rails 13*a*, 13*b* which, in the mounted condition, are spaced from the first guide rail 9 in a height direction.

Figure 4B:
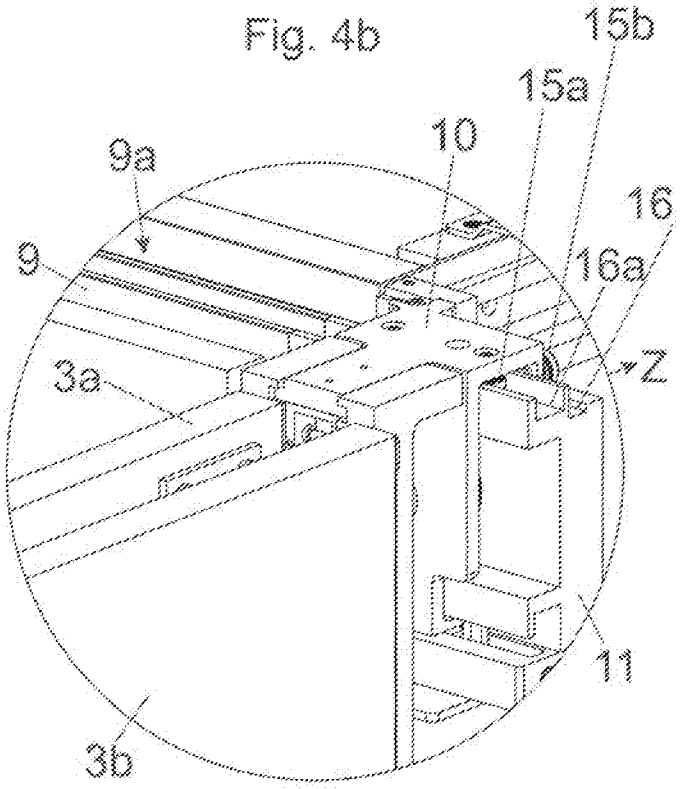
FIG. 4*a*, 4*b* show the guiding device located on the carrier, and an enlarged detail view thereof.
Figure 4A:
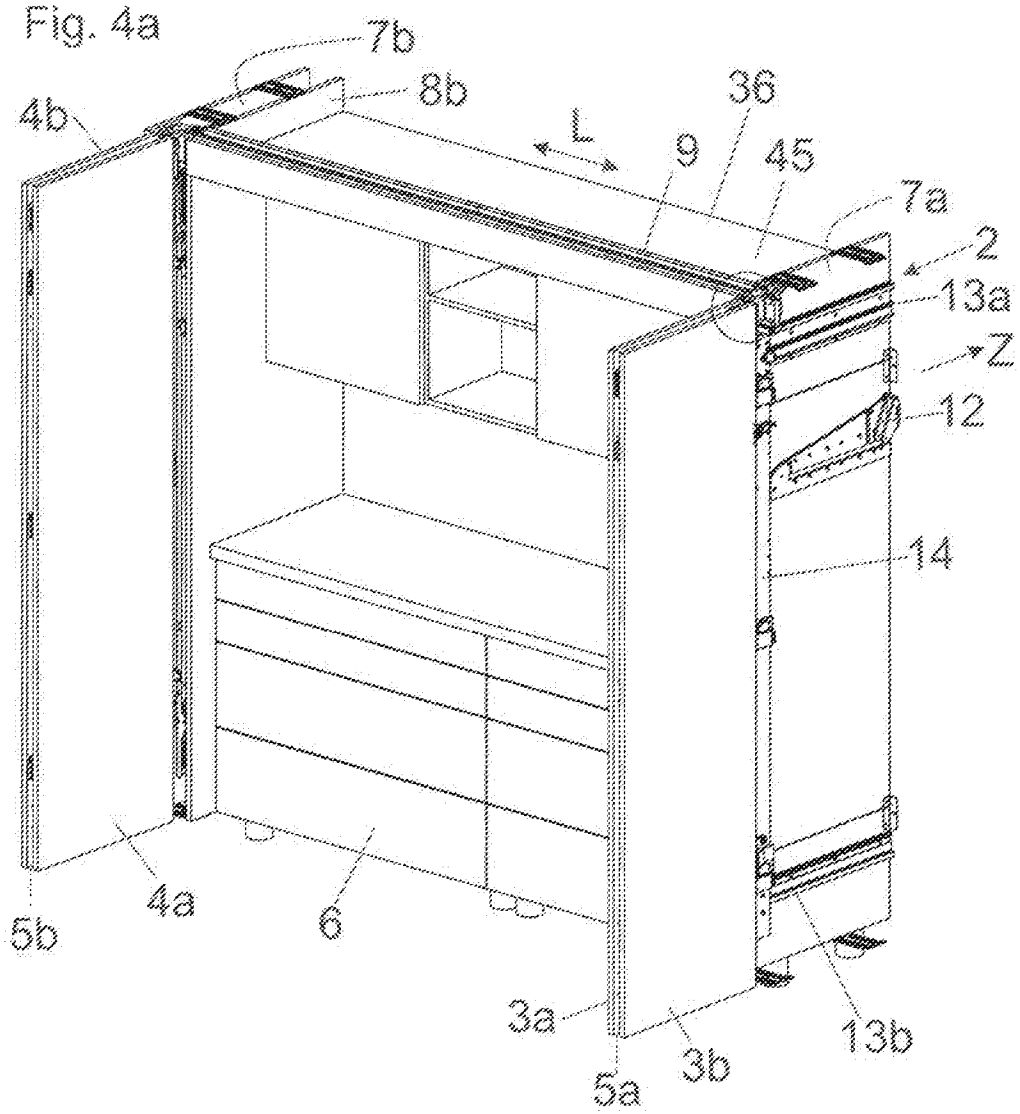

FIG. 4*a* shows the furniture parts 3*a* and 3*b*, after having been pivoted to one another starting from FIG. 3*a* about the vertical axis 5*a* and now adopt substantially a parallel position to one another. FIG. 4*b* shows the encircled region of FIG. 4*a* in an enlarged view, in which the guiding device 10 is arranged on the carrier 11 being located in the transfer position. It can be provided that a length of the carrier 11 measured in a longitudinal direction (L) is greater than a width of the guiding device 10 measured in the longitudinal direction (L). The profiled section 9*a* of the first guide rail 9 and the profiled section 11*a* of the carrier 11 are configured so as to be identical in a cross-sectional view and are aligned flush to one another in the transfer, so that the running wheels 15*a*, 15*b* of the guiding device 10 can be moved between the first guide rail 9 and the carrier 11 without a disturbing abutting edge. Starting from the positon position shown in FIG. 4*b*, the carrier 11, together with the guiding device 10 (and therewith the furniture parts 3*a*, 3*b*) can be driven by a force of the first drive device 12 at least over a region in the direction (Z).

Figure 5A:
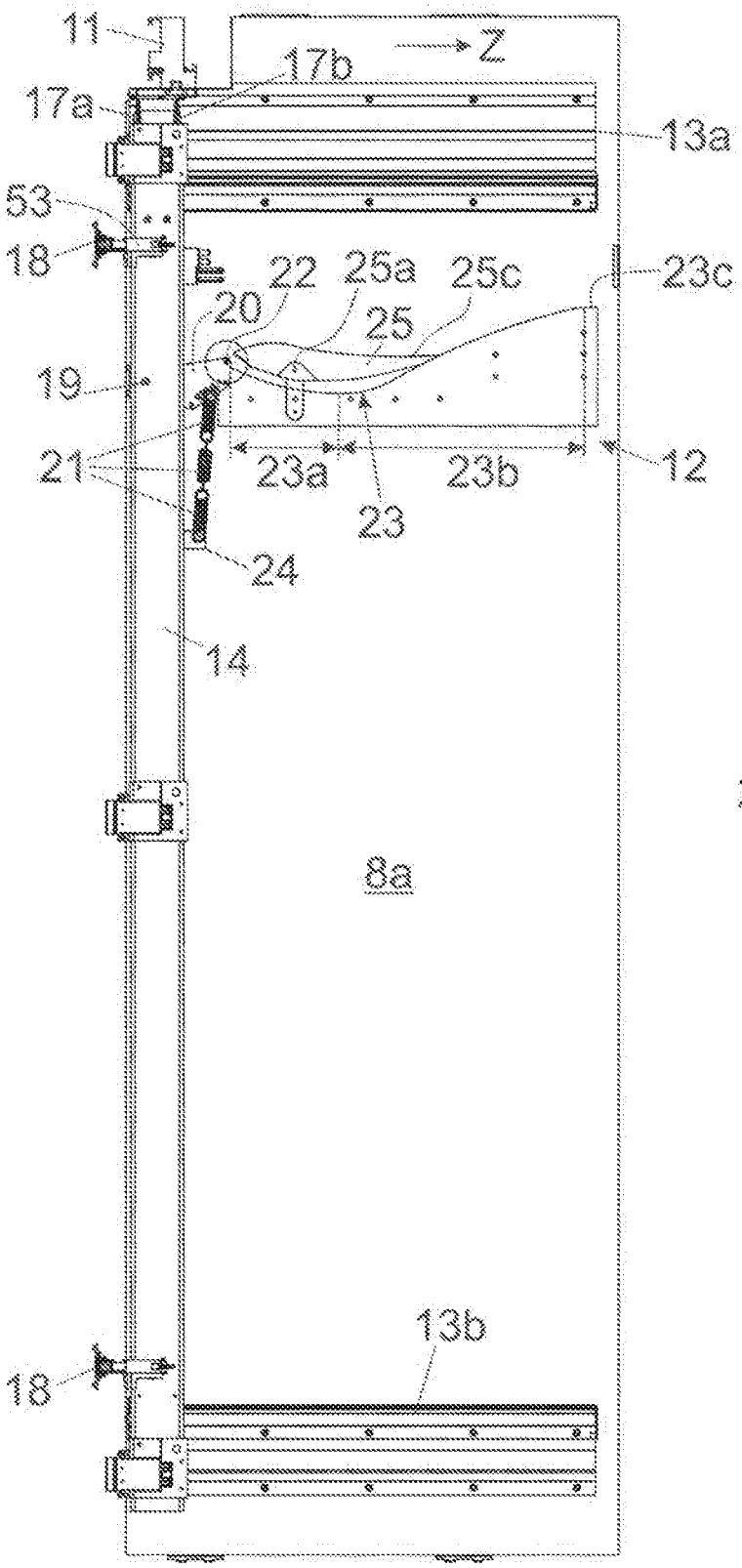
FIG. 5*a*, 5*b* show the guide system in a side view, and an enlarged detail view thereof.
Figure 5B:
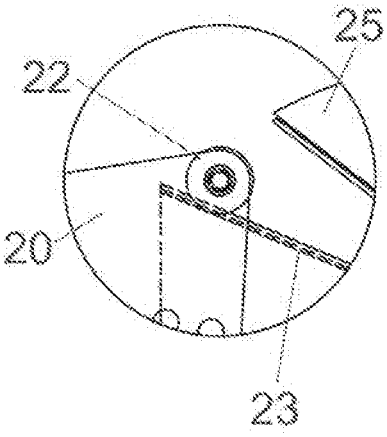

FIG. 5*a* shows a side view of the carrier 11 located in the transfer position, the carrier 11 being connected to the vertically extending column 14. The column 14, together with the carrier 11, is displaceable in the direction (Z)—for example by supporting rollers 17*a*, 17*b*—along the second guide rails 13*a*, 13*b* fixed to the side wall 8*a*. At least one fitting portion 18 is arranged on the column 14 for the movable support of the furniture part 3*b*, and it is preferably provided that the fitting portion 18 forms part of the second drive device 53 (FIG. 15*a*, 15*b*) by which the furniture parts 3*a*, 3*b* can be moved from a parallel position to one another into a coplanar position to one another. Arranged on the column 14 is a bearing portion 24 to which at least one, preferably a plurality of, force storage member(s) 21 of the first drive device 12 for retracting the furniture parts 3*a*, 3*b* in the direction (Z) is or are anchored. The force storage members 21, in the shown figure, are each configured as tension springs engaging on an entrainment member 20 pivotally mounted on the column 14 about a pivoting axis 19. A pressure roller 22 is pivotally arranged on the entrainment member 20, and the pressure roller 22 can be pressed against a concave-shaped control curve 23 of the first drive device 12 and can be displaced along that control curve 23 upon a movement of the column 14 in the direction (Z). The control curve 23 includes a retraction section 23*a* for partially retracting the carrier 11 in the direction (Z), and a tensioning section 23*b* adjoining the retraction section 23*a* for loading the force storage members 21. In FIG. 5*a*, the force storage members 21 are in a tensioned condition, so that the column 14 (and therewith the carrier 11), after unlocking of the carrier 11, can be retracted from the first guide rail 9 along the retraction section 23*a* by a force of the discharging force storage members 21 towards the lowest region of the control curve 23. In this way, the furniture parts 3*a*, 3*b* are also partially retracted into the insertion compartment 7*a*, whereby the furniture parts 3*a*, 3*b* are advantageously prepositioned for a continued movement into the insertion compartment 7*a* in the direction (Z). By a subsequent manual application of pressure to the furniture parts 3*a*, 3*b* aligned parallel to one another, in the region of the pivoting axis 5*a*, the column 14 (and therewith the pressure roller 22) are further moved in the direction (Z) along the tensioning section 23*b* of the control curve 23, whereby the force storage members 21 are again loaded. When the pressure roller 22 of the entrainment member 20 reaches the end section 23*c* of the control curve 23, the force storage members 21 are fully loaded, so that the furniture parts 3*a*, 3*b* can be moved upon an outward movement starting from a position, in which the furniture parts 3*a*, 3*b* are fully inserted into the insertion compartment 7*a*, at least partially in a direction opposite the direction (Z) by the energy storage members 21. Moreover, a movably-mounted switch member 25 with a setting contour 25*c* is provided, wherein it is preferably provided that the switch member 25 is configured to be tilted about a pivoting axis 25*a*. The pressure roller 22 can be displaced, starting from the aforesaid inserted position, along the setting contour 25*c* of the switch member 25 upon a movement opposite the direction (Z). As a result, the pressure roller 22 pressurized by the force storage members 21 needs not to overcome the hindering retraction section 23*a* of the control curve 23 upon a movement opposite the direction (Z), so that the retraction section 23*a* can be bypassed by the pressure roller 22 and a force of the force storage members 21 can be maintained over a longer displacement path. FIG. 5*b* shows the region encircled in FIG. 5*a* in an enlarged view.

Figure 6A:
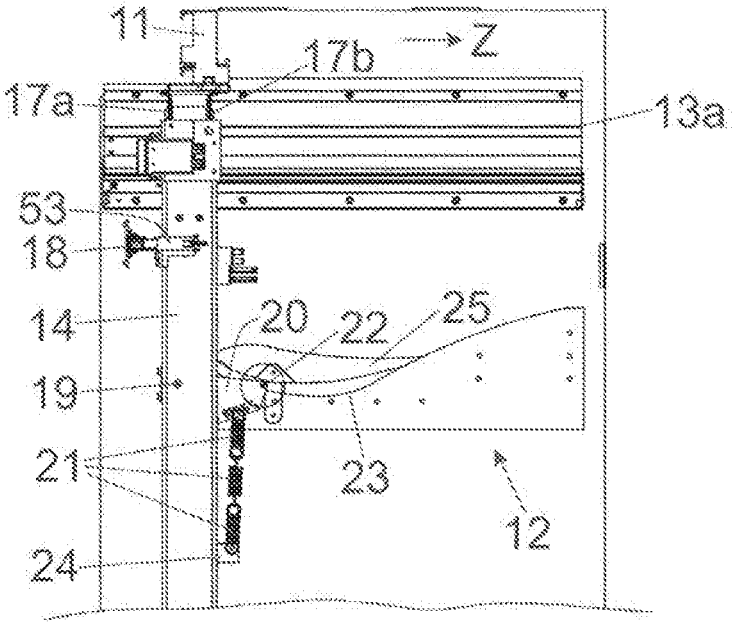
FIG. 6*a*-6*d* show the retraction operation of the carrier in two successive positions, and enlarged detail views thereof.
Figure 6B:
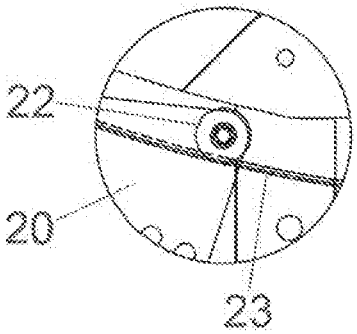
Figure 6C:
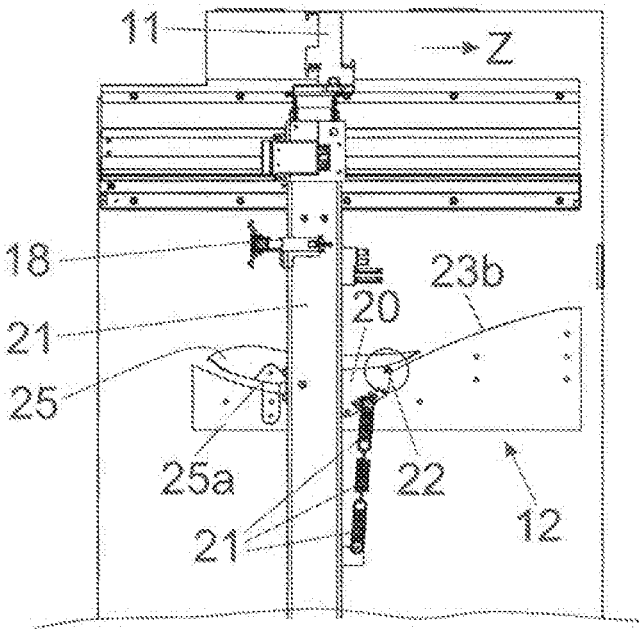
Figure 6D:
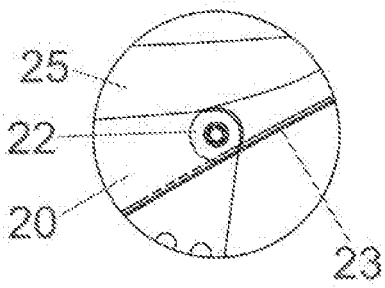

FIG. 6*a* shows a continued movement of the column 14 (and therewith of the carrier 11) in the direction (Z). Due to the reducing distance between the control curve 23 in the retraction section 23*a* (FIG. 5*a*) in relation to the bearing portion 24, the force storage members 21 relax and thereby pull the column 14 and the carrier 11 in the direction (Z). FIG. 6*b* shows the region encircled in FIG. 6*a* in an enlarged view. When the pressure roller 22 reaches the lowest region of the control curve 23, the pressure roller 22 is moved to the tensioning section 23*b* of the control curve 23 by applying a manual force to the furniture parts 3*a*, 3*b*, so that the force storage members 21 can be again loaded. The switch member 25 configured to be tilted about the pivoting axis 25*a* is thereby lifted by the pressure roller 22 (FIG. 6*c*), so that the pressure roller 22 can pass the switch member 22 in an unhindered manner upon a movement in the direction (Z) and can further be moved along the tensioning section 23*b*. Due to the eccentric arrangement of the switch member 25 about the pivoting axis 25*a*, a two-armed lever with lever arms of different lengths is formed, so that the switch member 25 with the longer lever arm loosely rests, preferably exclusively loaded by the force of gravity, against the tensioning section 23*b* of the control curve 23. If appropriate, the switch member 25 can also be pressed against the control curve 23 by a spring element. FIG. 6*d* shows the region encircled in FIG. 6*c* in an enlarged view.

Figure 7A:
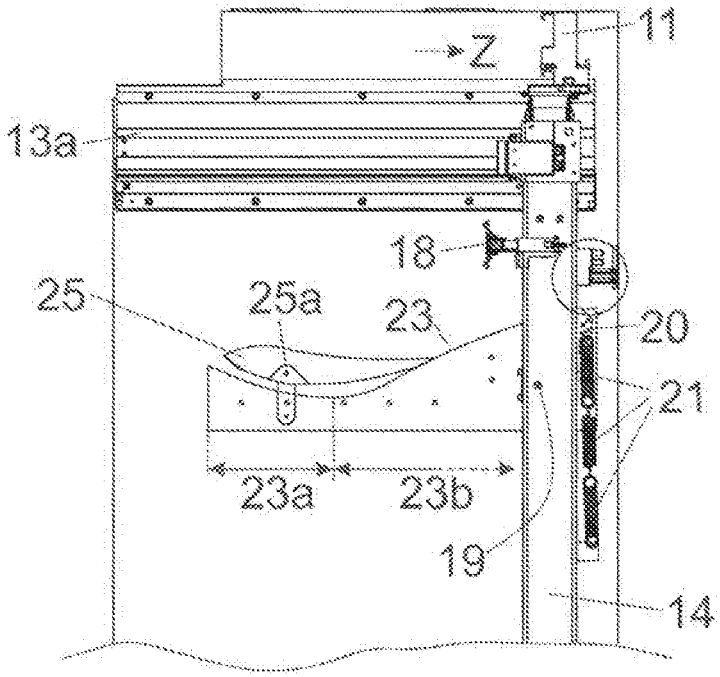
FIG. 7*a*-7*d* show the ejection operation in two successive positions, and enlarged detail views thereof.
Figure 7B:
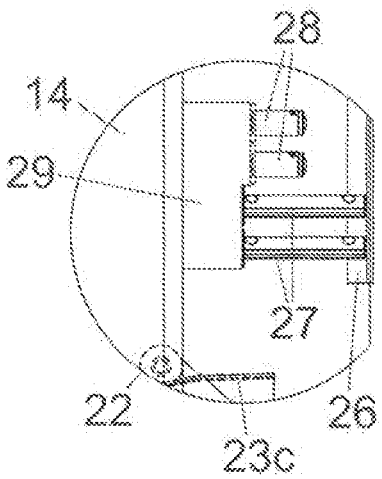

FIG. 7*a* shows the position of the column 14 right before reaching the fully inserted end position within the insertion compartment 7*a*. The pressure roller 22 has been moved along the tensioning section 23*b* of the control curve 23 and is located right before the horizontally extending end section 23*c* of the control curve 23, so that the column 14 is neither accelerated in the direction (Z) nor in a direction opposite the direction (Z). The force storage members 21 are thereby fully loaded. Arranged on the column 14 is a housing 29 in which a damping device 27 for dampening a closing movement of the column 14 and the carrier 11, respectively, is arranged. In the shown embodiment, the damping device 27 includes two, preferably hydraulic, linear dampers switched in a parallel relationship, and each of the linear dampers has a piston-cylinder-unit. These linear dampers, at the end of the closing movement of the column 14, hit against a stationary abutment portion 26, whereby the rams of the linear dampers are pressed-in and therewith the movement of the column 14 can be decelerated. Moreover, two ejection devices 28 are arranged in the housing 29, the ejection devices 28 each have a lockable energy storage member, and the two rams of the ejection devices 28 are configured to cooperate with the abutment portion 26 upon a closing movement of the column 14, so that the energy storage members of the ejection devices 28 can be loaded and can be locked in a loaded condition. FIG. 7*b* shows the region encircled in FIG. 7*a* in an enlarged view.

Figure 7C:
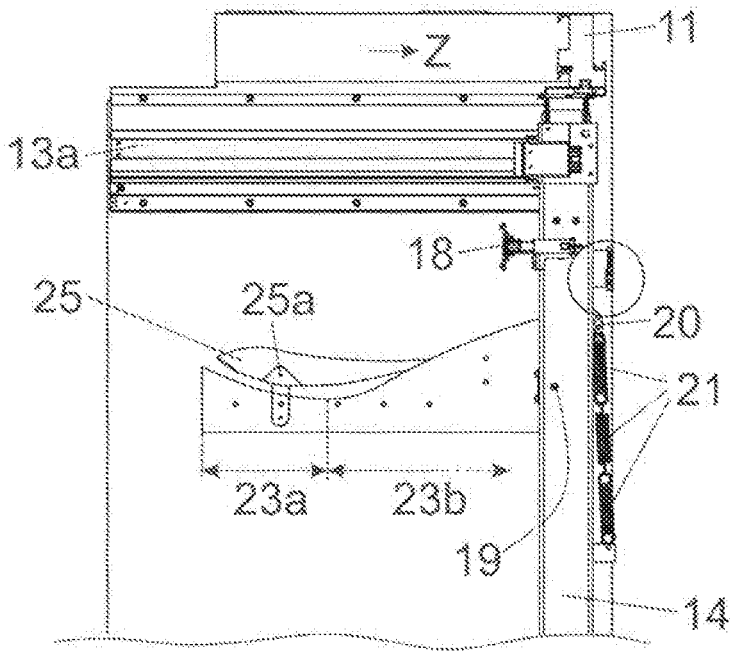
Figure 7D:
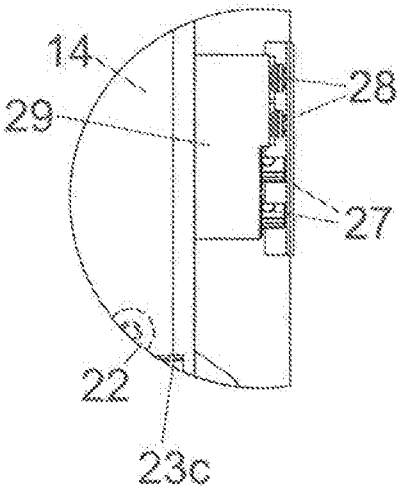

FIG. 7*c* shows the end position of the column 14, and the last closing movement of the column 14 has been decelerated by the damping device 27 and the lockable energy storage members of the ejection devices 28 are in a loaded condition. By overpressing the column 14, starting from its closed position, into an overpressing position located behind the closed position, the ejection devices 28 can be moved into an unlocking position, whereupon the column 14 can be again driven by a force of the ejection devices 28 and, subsequently, by a force of the loaded force storage members 21 in a direction opposite the direction (Z). FIG. 7*d* shows the region encircled in FIG. 7*c* in an enlarged view.

Figure 8A:
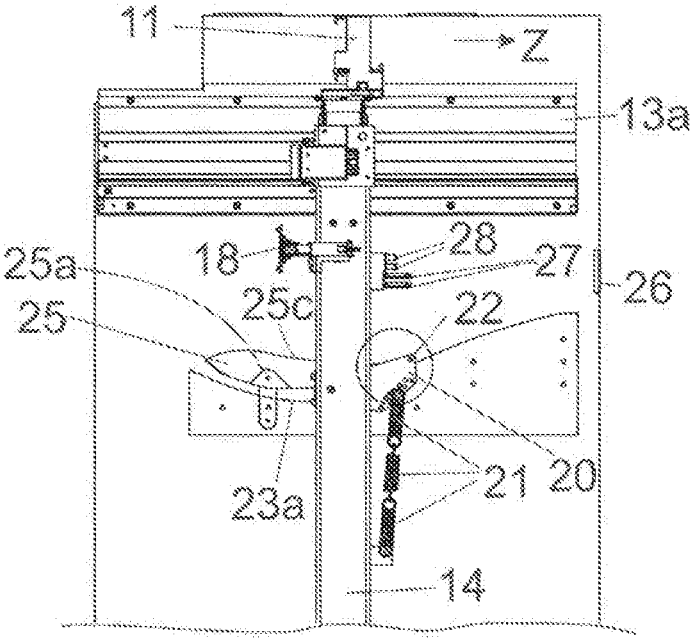
FIG. 8*a*-8*d* show continued positions starting from FIG. 7*a*, 7*b*, and enlarged detail views thereof.
Figure 8B:
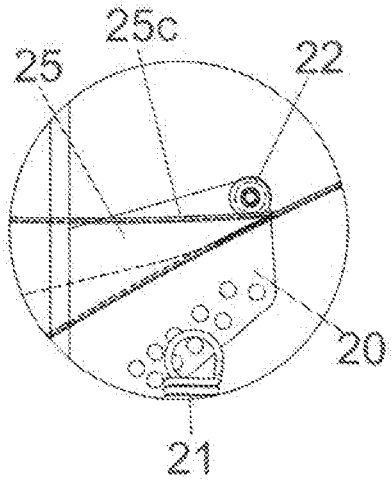

FIG. 8*a* shows a position of the column 14, after ejection of the ejection devices 28 in a direction opposite the direction (Z) has been performed. The pressure roller 22 is thereby located in a position entering the switch member 25. The pressure roller 22, upon a movement in a direction opposite the direction (Z), is configured to be displaced no longer along the retraction section 23*a*, but along the setting contour 25*c* arranged or formed on the switch member 25. In this way, a uniformly-extending ejection operation of the column 14 and of the furniture parts 3*a*, 3*b*, respectively, can be brought about, without substantial oscillations in the force of the force storage members 21, and the force of the force storage members 21 is maintained over a longer displacement path. FIG. 8*b* shows the region encircled in FIG. 8*a* in an enlarged view, in which the pressure roller 22 moves onto the setting contour 25*c* of the switch member 25 upon a movement of the column 14 in a direction opposite the direction (Z), without the pressure roller 22 needs to be displaced along the trough portion of the retraction section 23*a*.

Figure 8C:
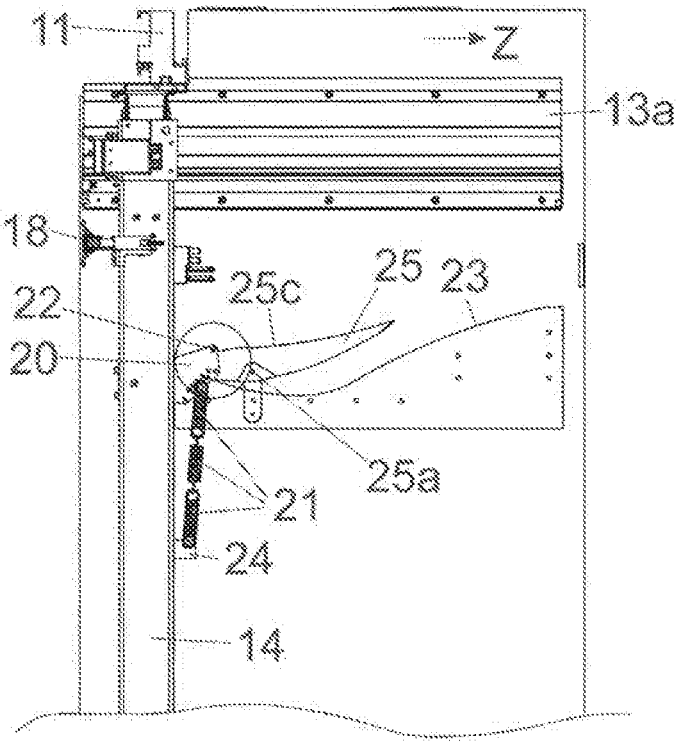
Figure 8D:
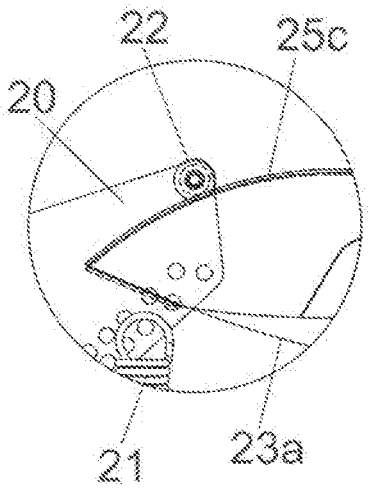

FIG. 8*c* shows a continued movement of the column 14 in a direction opposite the direction (Z), in which the pressure roller 22 has been moved along the setting contour 25*c* of the switch member 25 and in which the switch member 25 has been pivoted about the pivoting axis 25*a* in a counterclockwise direction. By this pivoting movement of the switch member 25 about the pivoting axis 25*a*, the pressure roller 22 is again returned to the initial region of the retraction section 23*a*. After the pressure roller 22 has abandoned the setting contour 25*c* of the switch member 25, the switch member 25 pivots about the pivoting axis 25*a* back into its initial position, i.e. in that position in which the longer lever arm of the switch member 25, in turn, rests against the control curve 23 due to its heavier weight.

Figure 9A:
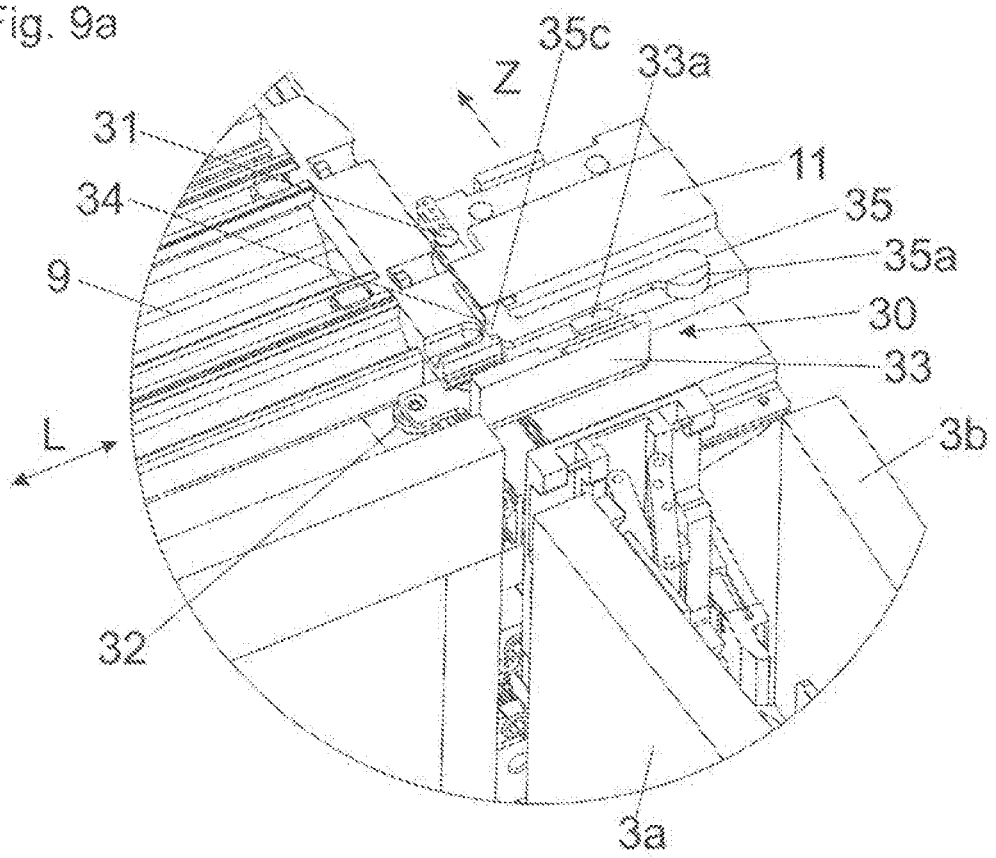
FIG. 9*a*, 9*b* show a possible embodiment for releasably locking between the carrier and the guide rail in two successive positions.
Figure 9B:
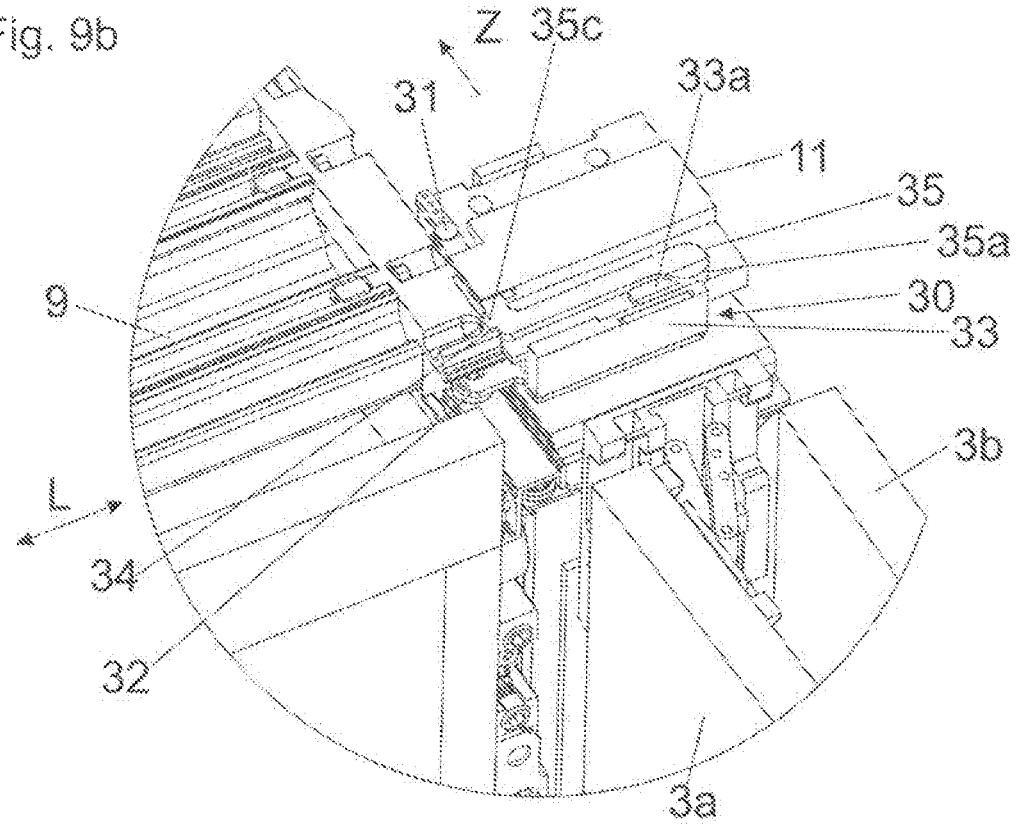

FIG. 9*a* and FIG. 9*b* show a possible embodiment of a locking device 30 for locking the carrier 11, in the transfer position or in a parking position, to the first guide rail 9. The locking device 30 is configured to be unlocked by a movement of the guiding device 10 into or onto the carrier 11. The first furniture part 3*a* is connected to the guiding device 10 configured to be moved in the longitudinal direction (L) along the first guide rail 9. A displacement piece 33 is motionally coupled to the guiding device 10, so that upon a movement of the guiding device 10 along the first guide rail 9, the displacement piece 33 also moves therewith. The displacement piece 33 has a protrusion 33*a* which, upon a movement in or on the carrier 11, is configured to cooperate with a counterstop 35*a* of a coupling lever 35 (FIG. 9*b*). The coupling lever 35 is pivotally mounted about a pivoting axis 31, and a locking element 35*c* can be moved by the coupling lever 35. The locking element 35*c* engages into a corresponding recess 34 of the first guide rail 9 in the locking position and thereby locks the carrier 11 relative to the first guide rail 9. It can be provided that the coupling lever 35, together with the locking element 35*c*, has a one-piece configuration. The coupling lever 35 can be prestressed in a direction of the locking position by a spring (not shown), so that the carrier 11, upon a movement of the carrier 11 in a direction opposite the direction (Z), can be automatically locked to the first guide rail 9 by a force of that spring, and the guiding device 10 can be again transferred back starting from the carrier 11 to the first guide rail 9.

Figure 10A:
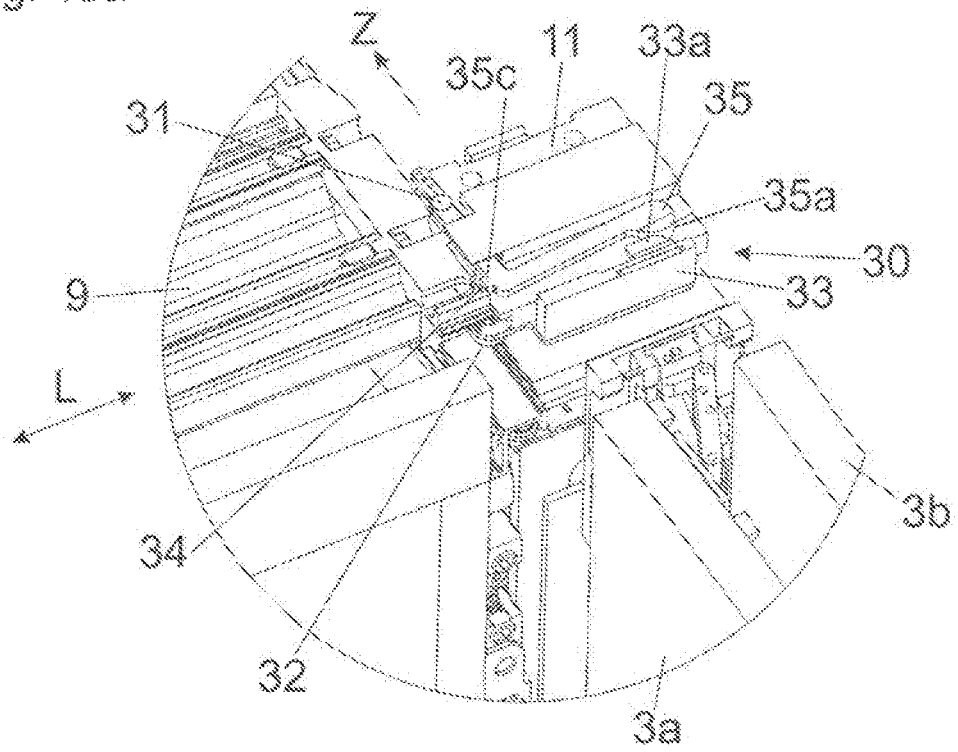
FIG. 10*a*, 10*b* show continued positions starting from FIG. 9*a*, 9*b*, FIG. 11*a*, 11*b* show the guide system with the carrier in a first position, and an enlarged detail view thereof.
Figure 10B:
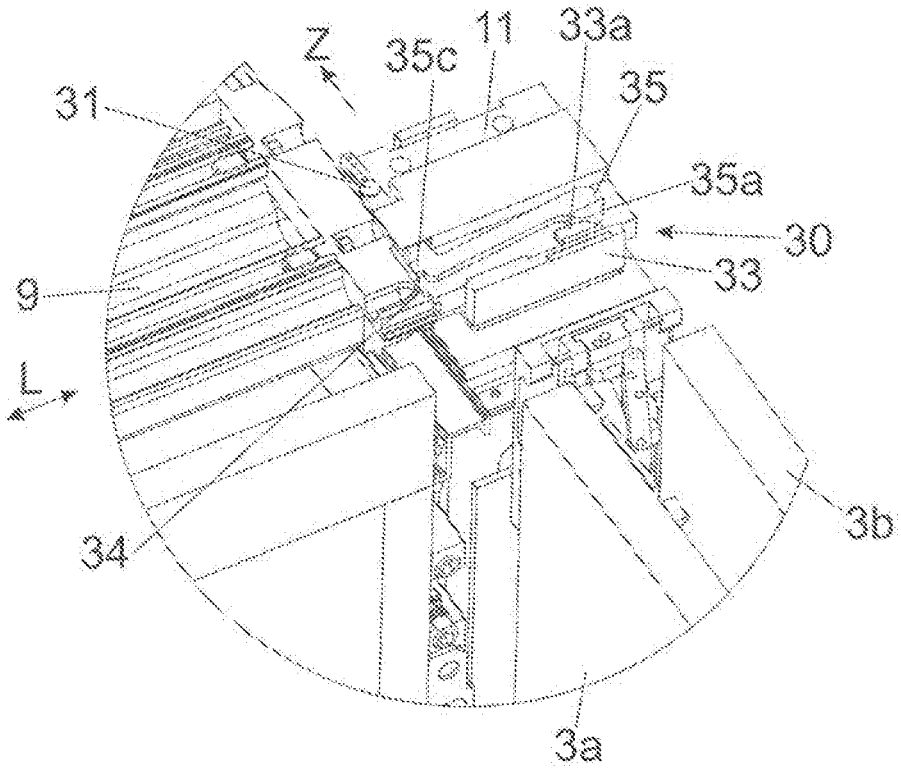

FIG. 10*a* and FIG. 10*b* show a continued movement of the displacement piece 33 motionally coupled to the guiding device 10 in the longitudinal direction (L), in which the protrusion 33*a* of the displacement piece 33 cooperates with the counterstop 35*a* of the coupling lever 35, and therewith pivots the coupling lever 35 about the pivoting axis 31. As a result, the locking element 35*c* is moved out from the recess 34 of the first guide rail 9, whereby the carrier 11 is released relative to the first guide rail 9 in order for a movement in the direction (Z) to be enabled. After unlocking has been effected, the carrier 11—together with the column 14—can be retracted at least partially in the direction (Z) by a force of the force storage members 21 of the above-described first drive device 12, and a spacing roller 32 pivotally mounted to the displacement piece 33 for laterally guiding the carrier 11 in the direction (Z) is configured to run along the side wall 8*a*.

Figure 11A:
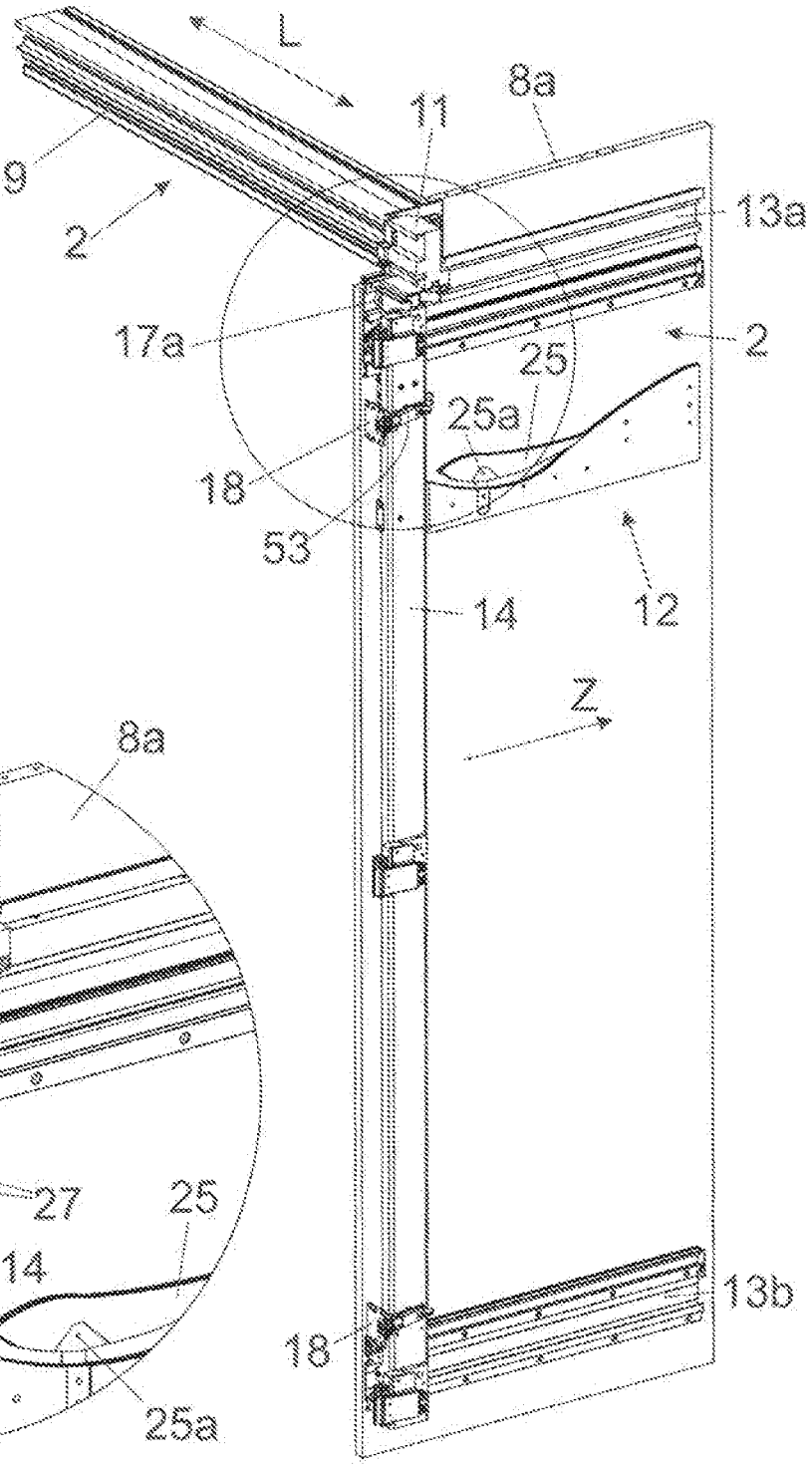

FIG. 11*a* shows the guide system 2, in which the carrier 11 can be locked to the first guide rail 9 by the above-described locking device 30 and in which the carrier 11 can be moved from the transfer position in a direction (Z) extending transversely to the longitudinal direction (L). On the side wall 8*a*, which can partially form the insertion compartment 7*a*, second guide rails 13*a* and 13*b* and the switch member 25 tiltable about the pivoting axis 25*a* are attached, the second guide rails 13*a*, 13*b* are provided for the displaceable support of the column 14.

Figure 11B:
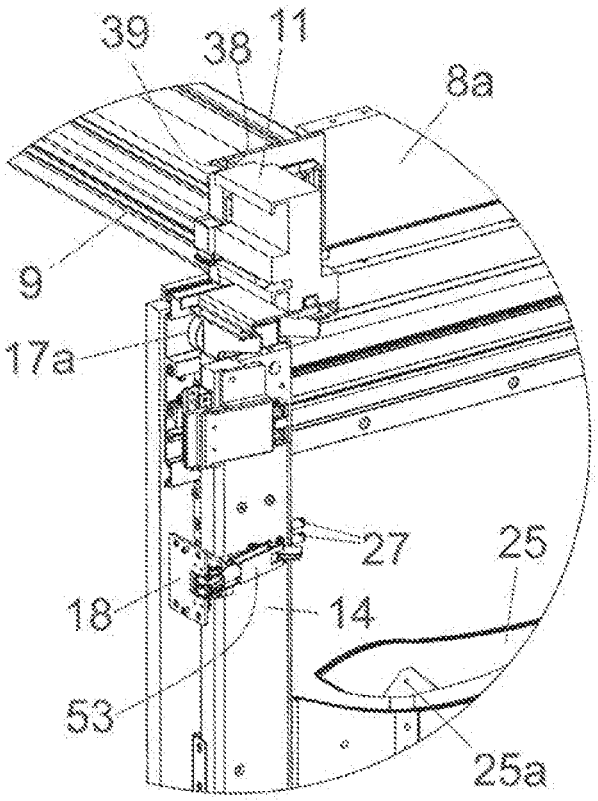

FIG. 11*b* shows the region encircled in FIG. 11*a* in an enlarged view, in which the carrier 11 has already been moved out from the transfer position and has slightly been moved in the direction (Z). For limiting a movement of the carrier 11 in a direction opposite the direction (Z), at least one abutment element 38 is arranged on the carrier 11. The abutment element 38 is configured to abut against a counterstop 39 of the first guide rail 9 and therewith prevents a further movement of the carrier 11 in a direction opposite the direction (Z). For the displaceable support of the carrier 11 and the column 14, at least one supporting roller 17*a* can be provided configured to run along a running limb arranged or formed on the second guide rail 13*a*. Visible is the damping device 27 arranged on the column 14, the damping device 27 is provided for dampening a movement of the column 14 within an end position range being remote from the transfer position.

Figure 12A:
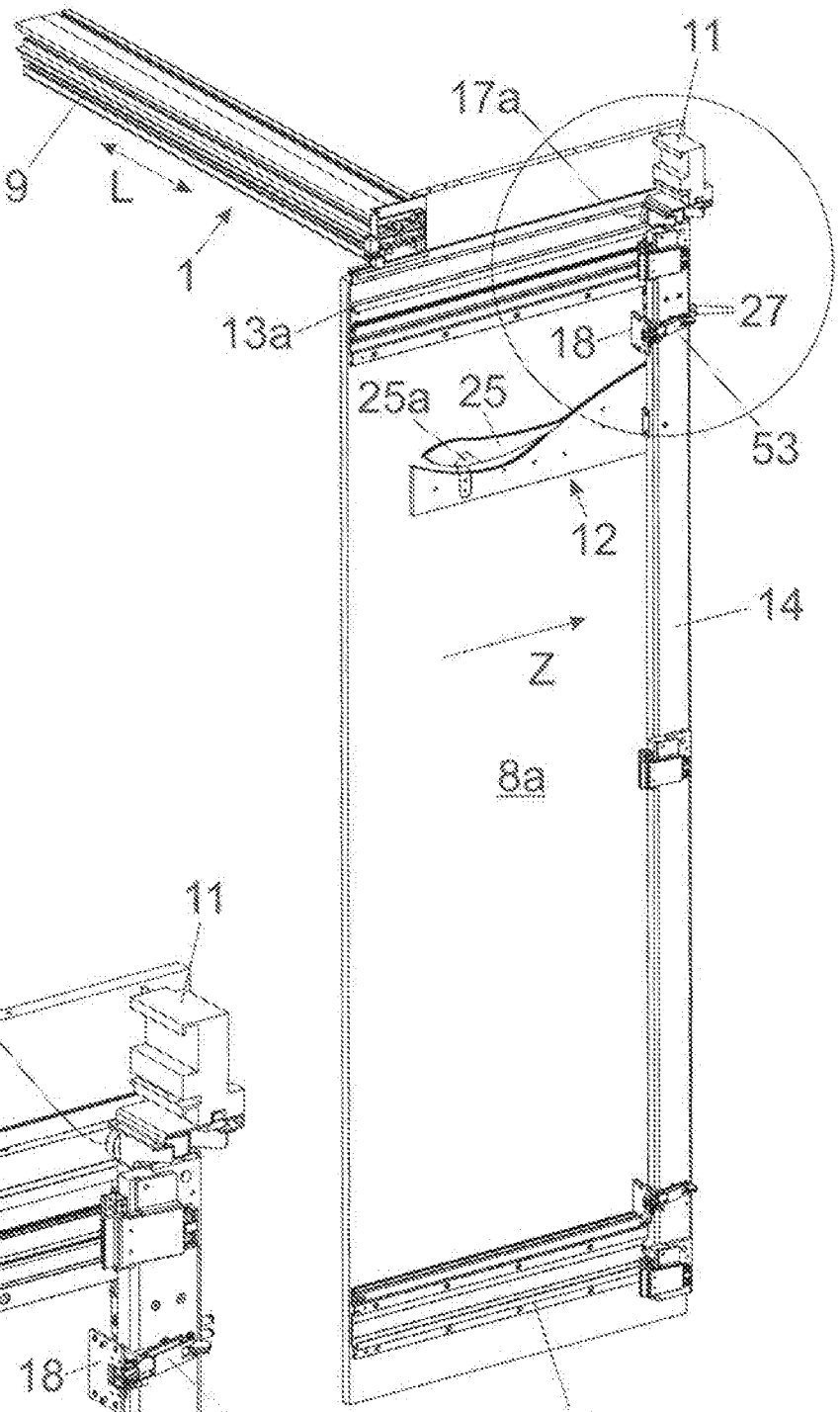
FIG. 12*a*, 12*b* show the guide system with the carrier in a second position, and an enlarged detail view thereof.
Figure 12B:
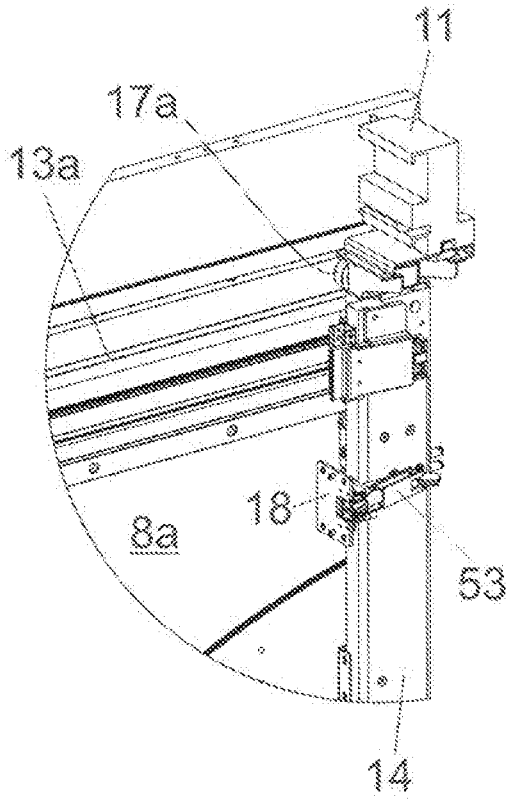

FIG. 12*a* shows the carrier 11 in a position remote from the first guide rail 9, and this position corresponds to the position of the furniture parts 3*a*, 3*b* when fully inserted into the insertion compartment 7*a*. Starting from the position shown in FIG. 12*a*, the furniture parts 3*a*, 3*b* can be ejected by the ejection devices 28 (not shown here) in a direction opposite the direction (Z). FIG. 12*b* shows the region encircled in FIG. 12*a* in an enlarged view.

Figure 13A:
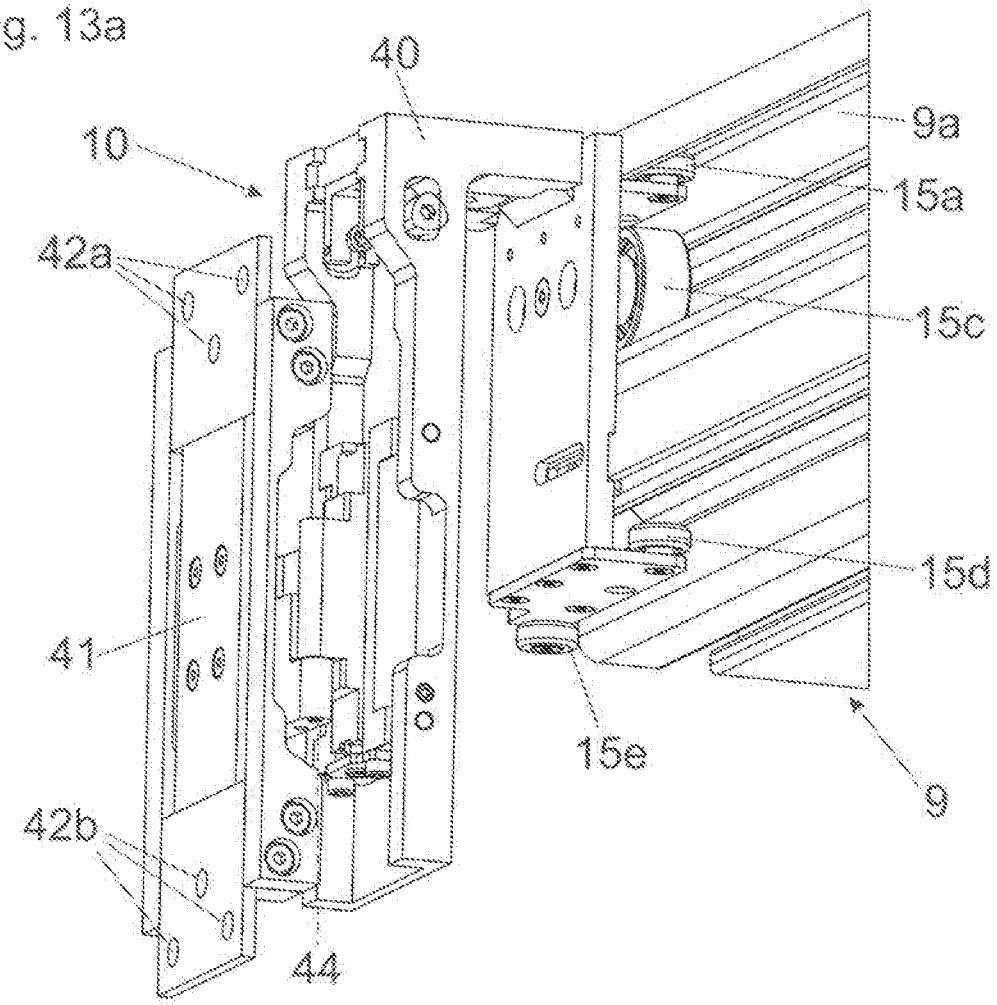
FIG. 13*a*, 13*b* show the guiding device movably supported on the guide rail in a perspective view and in a cross-sectional view.

FIG. 13*a* shows a perspective view of the guiding device 10 movably supported on the first guide rail 9. The guiding device 10 can include a plurality of running rollers 15*a*, 15*c*, 15*d*, 15*e* having vertically and horizontally extending rotational axes, and the running rollers 15*a*, 15*c*, 15*d*, 15*e* are configured to run along a profiled section 9*a* of the first guide rail 9. The guiding device 10 includes a holding arm 40, and a fitting portion 41 configured to be fixed to the first furniture part 3*a* is pivotally connected to the holding arm 40 by a vertically extending pivoting axis 44 when mounted. The fitting portion 41 includes a plurality of fastening locations 42*a*, 42*b* for fixing to the first furniture part 3*a*.

Figure 13B:
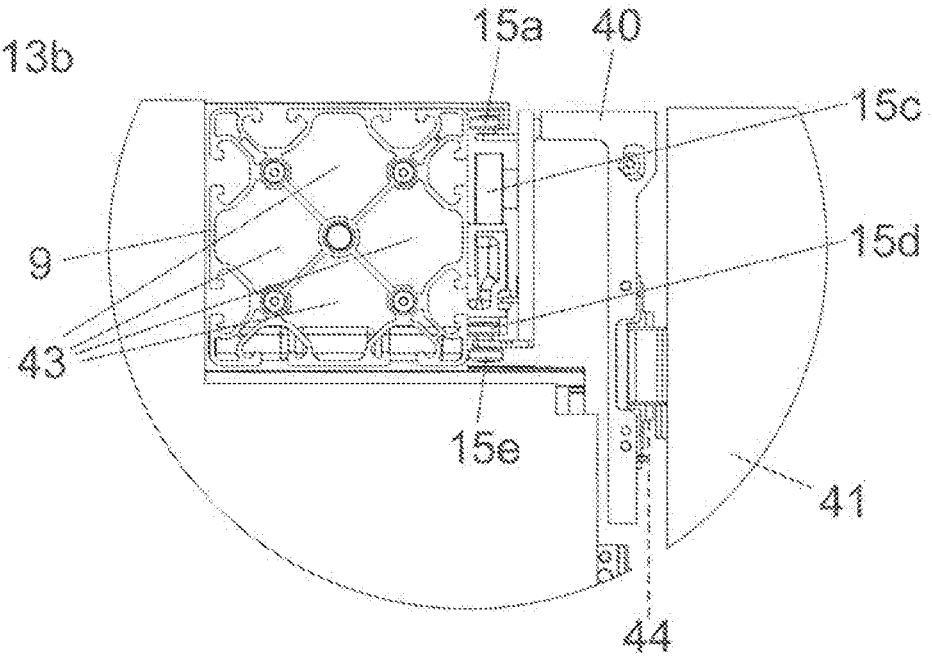

FIG. 13*b* shows a cross-sectional view of the guiding device 10 movably supported on the first guide rail 9. The first guide rail 9, in a cross-sectional view, has a plurality of cavities 43 spaced from one another by profiled limbs. The running rollers 15*a*, 15*c*, 15*d*, 15*e* are configured to run along the first guide rail 9, and the fitting portion 41 configured to be fixed to the first furniture part 3*a* is pivotally connected to the holding arm 40 by the vertically extending pivoting axis 44.

Figure 14A:
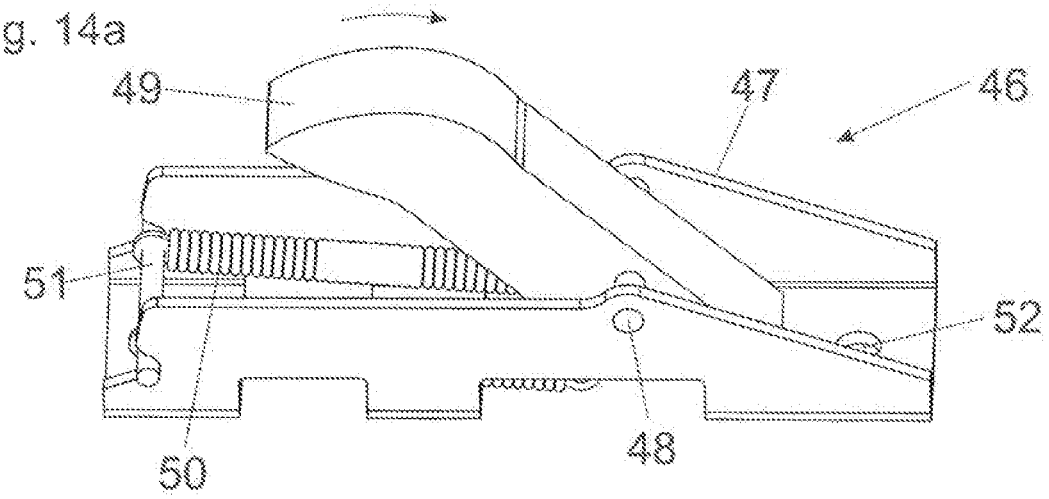
FIG. 14*a*-14*d* show a possible embodiment of a spreading device for spreading the furniture parts apart, and schematic views of the spreading-apart operation.
Figure 14B:
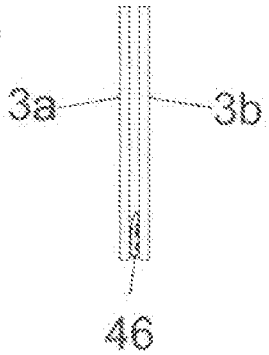
Figure 14C:
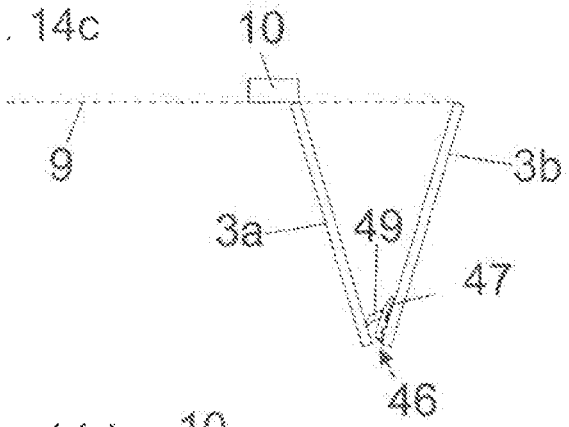
Figure 14D:
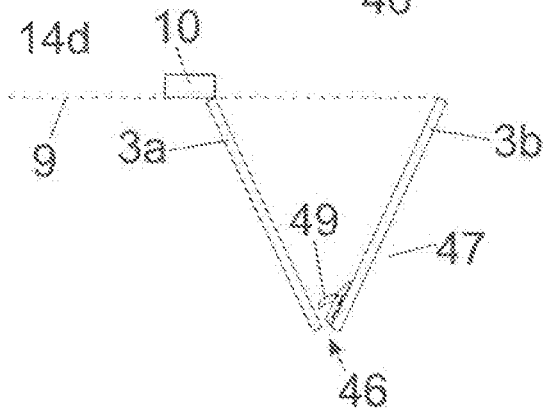

FIG. 14*a* shows a possible embodiment of a spreading device 46 for spreading apart the furniture parts 3*a*, 3*b*, after having been moved out from the lateral insertion compartment 7*b*. The spreading device 46 includes a mounting portion 47 to be fixed to one of the furniture parts 3*a*, 3*b*, the mounting portion 47 has one or a plurality of bore(s) 52 for the passage of a screw. A spreading lever 49 is pivotally mounted about an axis 48 on the mounting portion 47. A spring element 50 (in this case a tension spring) is fixed to a bearing bolt 51 and pulls the spreading lever 49 continuously about the axis 48 in a direction of the depicted arrow. By the spreading device 46, the two furniture parts 3*a*, 3*b* continuously have the tendency to be spreaded apart. When now the furniture parts 3*a*, 3*b* are fully moved out from the lateral insertion compartment 7*a*, the furniture parts 3*a*, 3*b*, by virtue of the spring-loaded spreading lever 49, are spreaded apart, starting from a position in which the furniture parts 3*a*, 3*b* are aligned parallel to one another, into a further position in which the furniture parts 3*a*, 3*b* adopt an angled position to one another. The guiding device 10 connected to the first furniture part 3*a* can be displaced along the first guide rail 9 by a force of the spring element 50 and, as a result, also the second furniture part 3*b* is pulled therewith (FIG. 14*b*-14*d*).

Figure 15A:
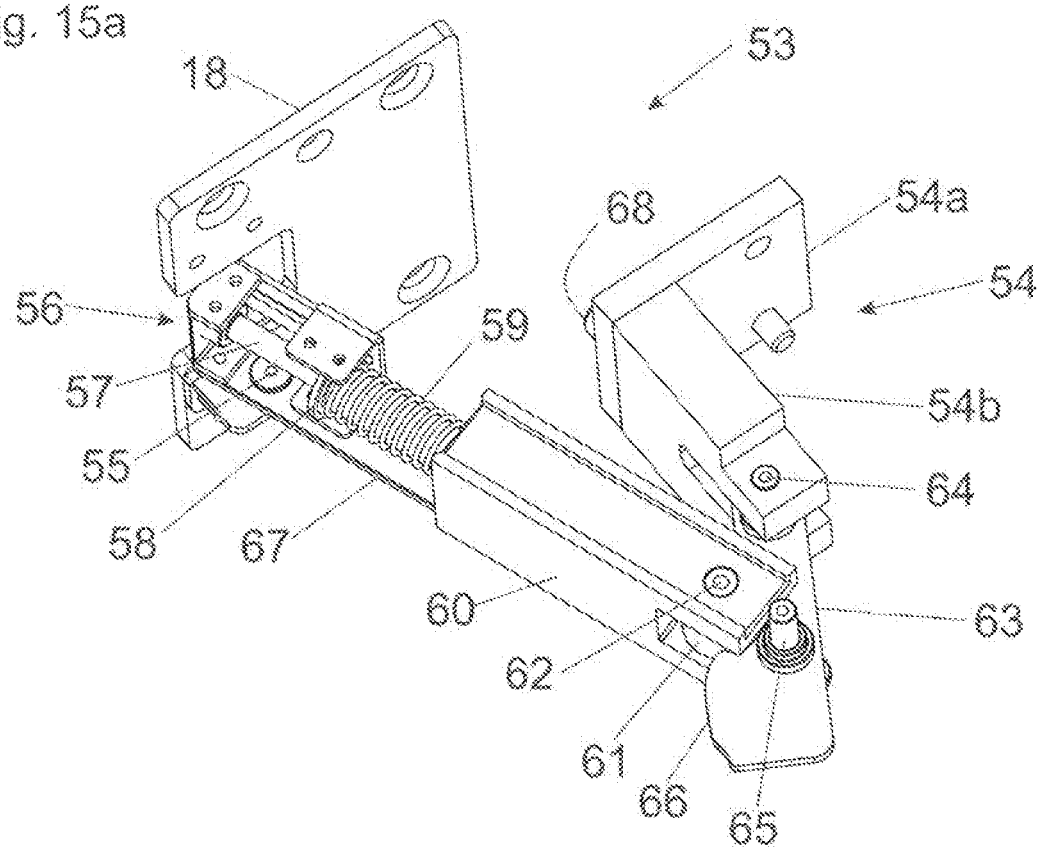
FIG. 15*a*, 15*b* show the second drive device in a perspective view and in a cross-sectional view.

FIG. 15*a* shows a possible embodiment of the second drive device 53 for driving the furniture parts 3*a*, 3*b* from a parallel or angled position into a coplanar position to one another. The second drive device 53 includes at least one actuating arm 67 connected to the second fitting portion 18, a spring device 59 for applying a force to the at least one actuating arm 67, a control curve 66 and a roller 61 pressurized by the spring device 59, and the roller 61 is configured to run along the control curve 66 upon a movement of the actuating arm 67. The second drive device 53 further includes a fitting portion 54 which is, for example, to be fixed to the vertically extending column 14. In this case, the fitting portion 54 has a two-part configuration and includes a first portion 54*a* to be fixed to the column 14 and a second portion 54*b*. A position of the second portion 54*b* relative to the first portion 54*a* can be adjusted by rotating an adjustment wheel 68. The second portion 54*b* is connected to an intermediate piece 63 by an axis 64, and the control curve 66 is formed or arranged on the intermediate piece 63. The intermediate piece 63 is connected to a housing portion 60 via a further axis 65, and the roller 61 is rotatably arranged on the housing portion 60 about an axis 62 and can be pressed against the control curve 66 by a force of the spring device 59. The housing portion 60 is configured so as to at least partially accommodate the spring device 59 and is displaceably mounted relative to the actuating arm 67, and the actuating arm 67 is hingedly connected via the axis 55 to the fitting portion 18 to be fixed to the second furniture part 3*b*. By an adjustment device 56 with an adjusting screw 57, a force of the spring device 59 applied to the second furniture part 3*a* can be adjusted. Upon a rotation of the adjusting screw 57 with the aid of a tool, an abutment element 58 can be adjusted along a threaded portion arranged on the adjusting screw 57. The spring device 59 is configured as a compression spring and is supported with a first end region on the abutment element 58 which, upon a rotation of the adjusting screw 57, can be adjusted along the threaded portion of the adjusting screw 57, whereby the spring device 59 is variably prestressed. The second end of the spring device 59 presses against the roller 61 configured to be displaced along the control curve 66 upon a movement of the actuating arm 67.

Figure 15B:
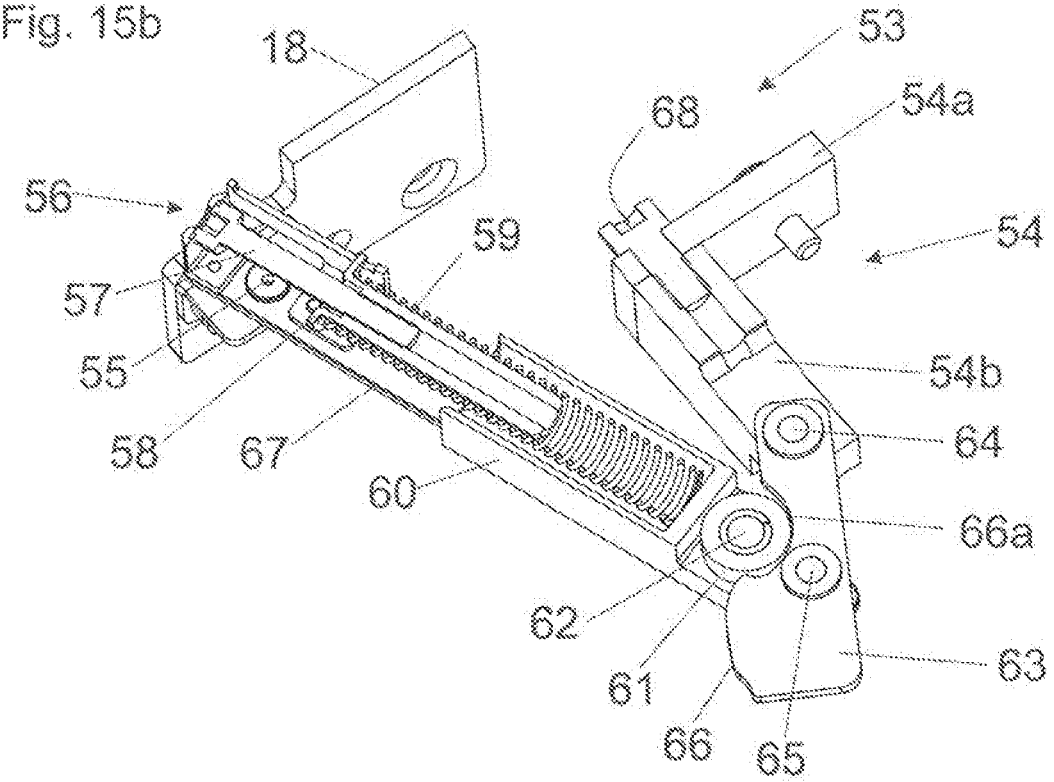

FIG. 15*b* shows the second drive device 53 according to FIG. 15*a* in a cross-sectional view, in which the roller 61 is releasably locked to a first locking section 66*a* of the control curve 66. As a result, the two furniture parts 3*a*, 3*b*, in the mounted condition, are held with a predetermined force in a coplanar position to one another. Here, the first locking section 66*a* of the control curve 66 is trough-shaped, and the roller 61 can be moved out from the trough-shaped locking section 66*a* by a movement of the fitting portion 18. After a holding force has been overcome, the roller 61 can further be moved along the control curve 66.

Figure 16A:
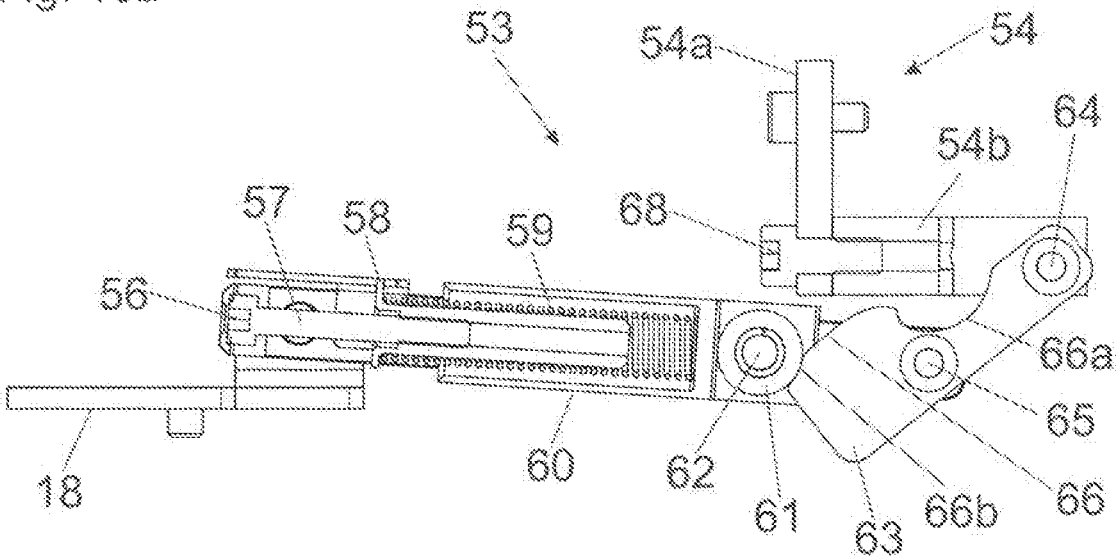
FIG. 16*a*, 16*b* show the second drive device in a first relative position in which the furniture parts, in the mounted condition, are aligned parallel to one another, and in a second relative position.

FIG. 16*a* shows a cross-sectional view of the second drive device 53 according to FIG. 15*a* and FIG. 15*b*, in which the fitting portion 18 is positioned such that the two furniture parts 3*a*, 3*a* are aligned parallel to one another in the mounted condition and can be moved into and out from the lateral insertion compartment 7*a*. The pressure roller 61 pressurized by the spring device 59 is thereby releasably locked to a second trough-shaped locking section 66*b* of the control curve 66, so that the two furniture parts 3*a*, 3*b* are held with a predetermined force in a parallel position to one another in the mounted condition. After moving out the furniture parts 3*a*, 3*b* from the lateral insertion compartment 7*a*, the furniture parts 3*a*, 3*b* can be spreaded apart, for example by the spreading device 46 shown in FIG. 14*a*, and the roller 61 is moved out from the second locking section 66*b* and, as shown in FIG. 16*b*, can further be moved along the control curve 66, and the furniture parts 3*a*, 3*b* can be moved from the parallel aligned position to one another in a direction towards the coplanar position.

Figure 16B:
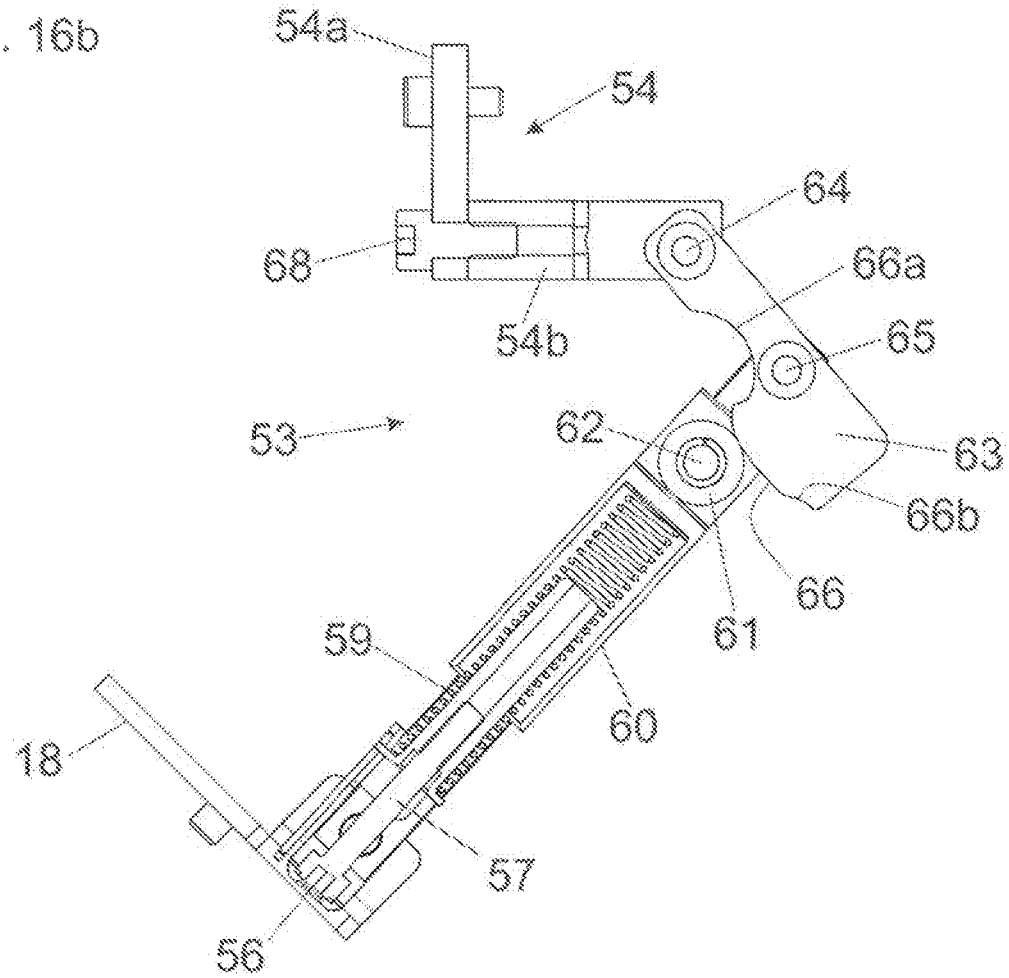
Figure 17A:
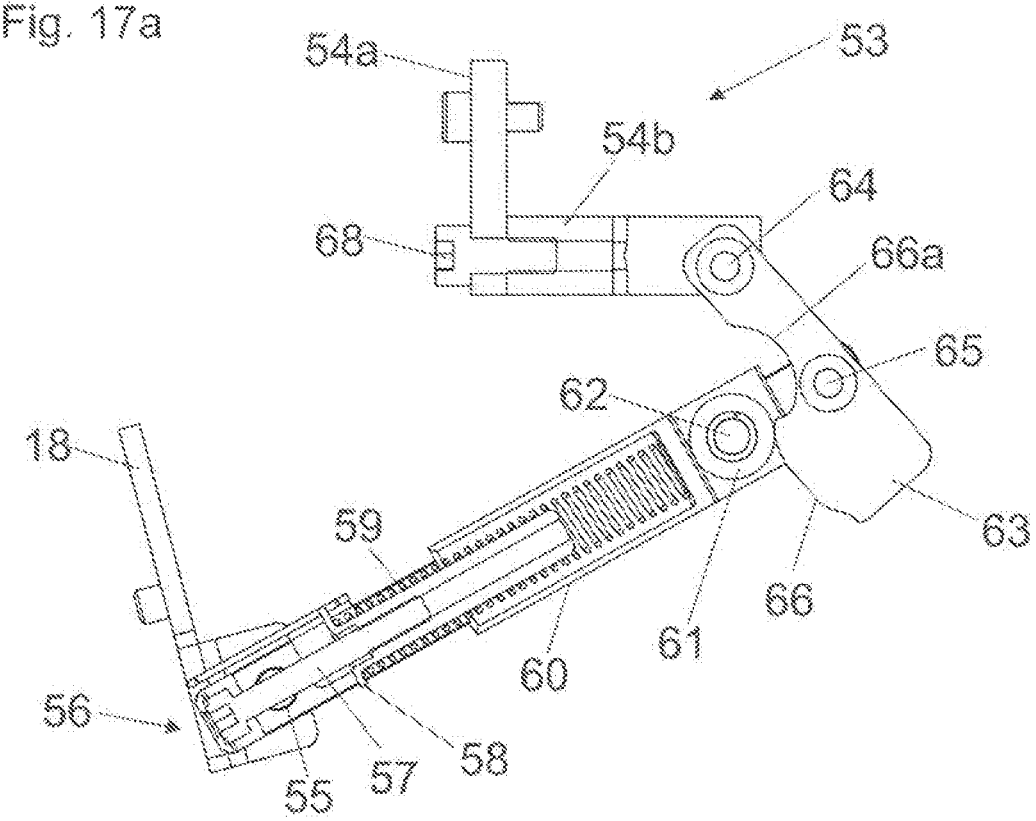
FIG. 17*a*, 17*b* show the second drive device in a third relative position and in a fourth relative position in which the furniture parts, in the mounted condition, are aligned coplanar to one another.
Figure 17B:
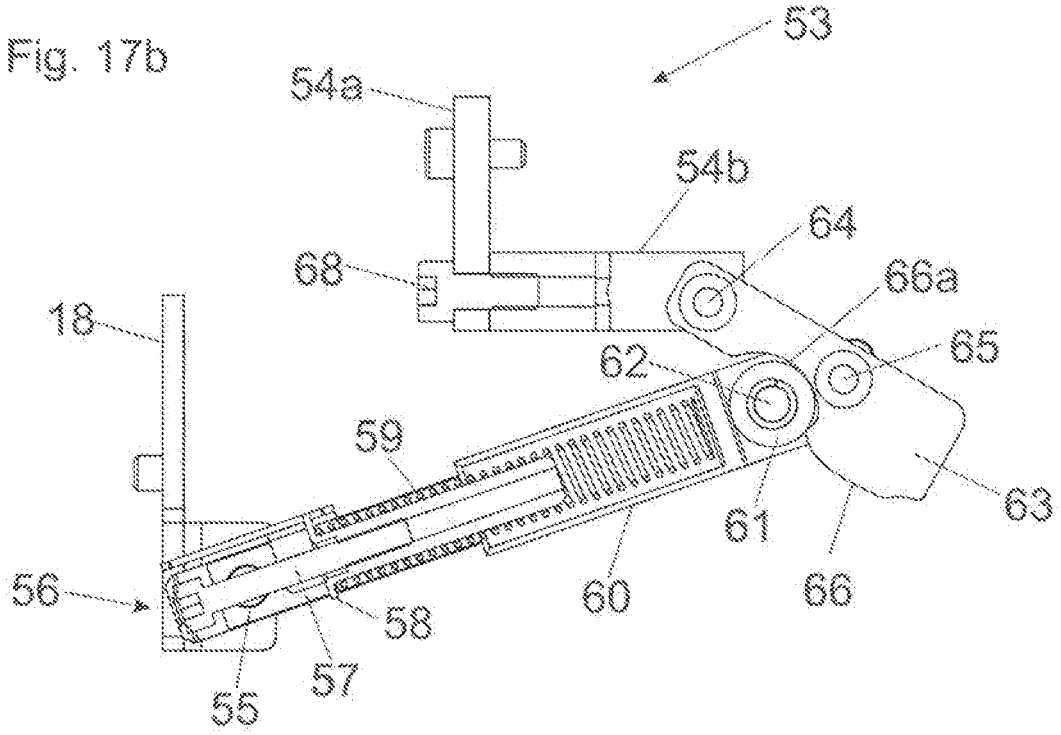

FIG. 17*a* shows, in comparison to FIG. 16*a* and FIG. 16*b*, continued movement of the second drive device 53, so that the two furniture parts 3*a*, 3*b* are also further moved in a direction towards the coplanar position. Upon an entry of the roller 61 into the first locking section 66*a* of the control curve 66, the spring device 59 configured as a compression spring can relax, so that the roller 61 is pressed into the first locking section 66*a* by a force of the expanding spring device 59, as shown in FIG. 17*b*. In this way, the fitting portion 18 (which is connected to the second furniture part 3*b* in the mounted condition) is also moved in a position in which the fitting portion 18 and the fitting portion 41 of the guiding device 10 (FIG. 13*a*) are aligned such that the furniture parts 3*a*, 3*b*, which are connected to the fitting portions 18, 41 in the mounted condition. are aligned substantially coplanar to each other.

Figure 18:
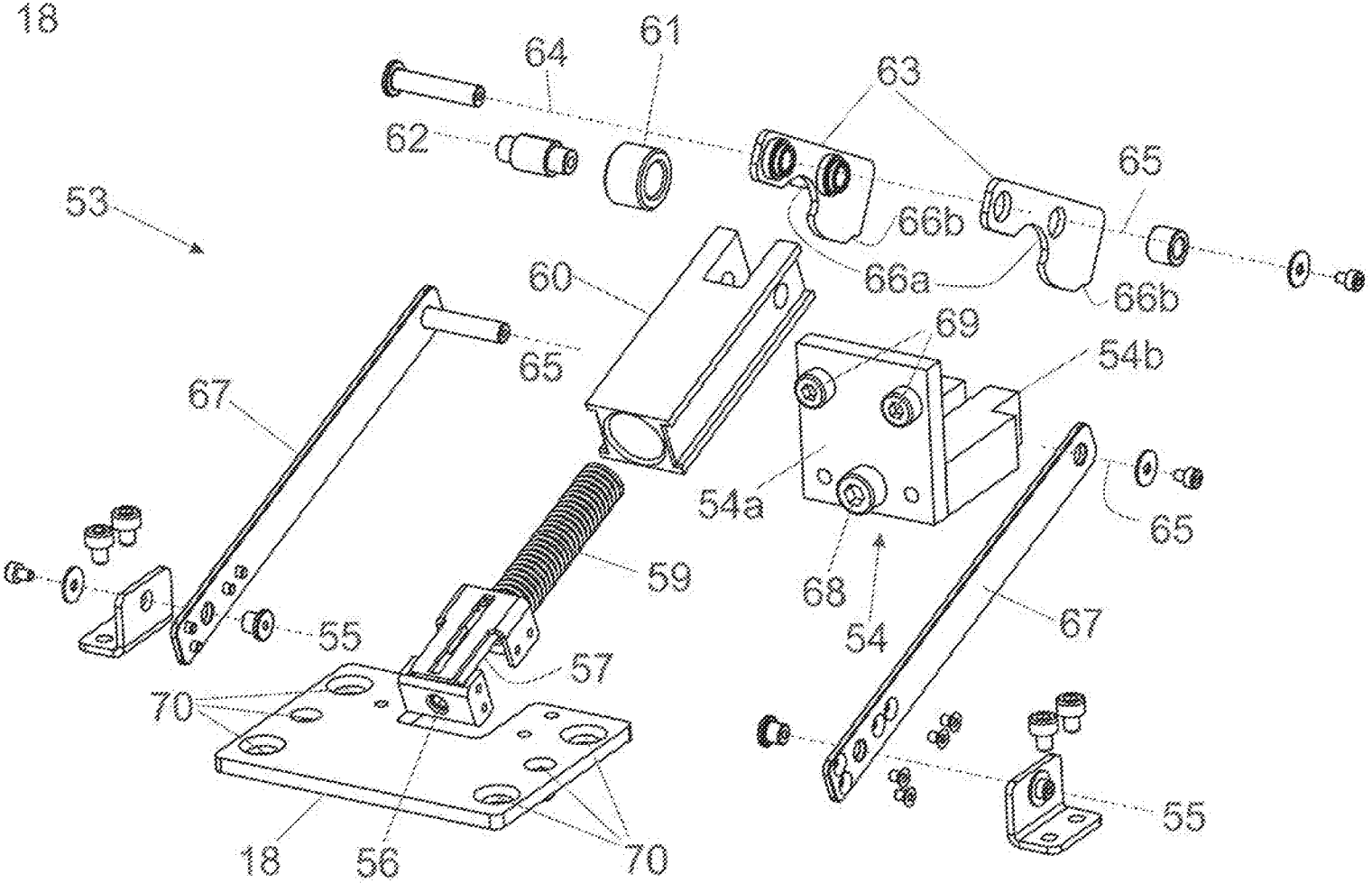
FIG. 18 shows the second drive device in an exploded view.

FIG. 18 shows the second drive device 53 in an exploded view. The second drive device 53 includes the second fitting portion 18 to be fixed to the second furniture part 3*b* and a third fitting portion 54 which is preferably to be fixed to the vertical column 14. The third fitting portion 54 is hingedly connected to the intermediate piece 63 by the axis 64 and to the actuating arm 67 by the axis 65. The actuating arm 67 is pivotally connected to the fitting portion 18 by the axis 55. The second fitting portion 18 includes at least one fastening location 70 for fixing to the second furniture part 3*b*, and the third fitting portion 54 is to be mounted to the column 14 by at least one fastening means 69. The control curve 66 can be shaped such that the second furniture part 3*b* connected to the fitting portion 18 can be driven starting from a position, in which the two furniture parts 3*a*, 3*b* are aligned coplanar to one another, within an angle range starting from approximately 40° towards the aforementioned coplanar position by a force of the spring device 59.

LIST OF REFERENCE NUMBERS

1 rail arrangement
2 guide system
3*a*, 3*b* furniture parts
4*a*, 4*b* furniture parts
5*a*, 5*b* vertical pivoting axes
6 furniture carcass
7*a*, 7*b* insertion compartments
8*a*, 8*b* side walls
9 first guide rail
9*a* profiled section of the guide rail
10 guiding device
11 carrier
11*a* profiled section of the carrier
12 retraction device
13*a*, 13*b* second guide rails
14 column
15*a*, 15*b*, 15*c*, 15*d*, 15*e* running rollers
16*a*, 16*b* guide channels
17*a*, 17*b* supporting rollers
18 fitting portion
19 pivoting axis of entrainment member
20 entrainment member
21 force storage members
22 pressure roller
23 control curve
23*a* retraction section of control curve
23*b* tensioning section of control curve
23*c* end section of control curve
24 bearing portion
25 switch member
25*a* pivoting axis of switch member
25*c* setting contour of switch member
26 stationary abutment portion 26
27 damping device
28 ejection devices
29 housing
30 locking device
31 pivoting axis of coupling lever
32 spacing roller
33 displacement piece
33*a* protrusion of displacement piece
34 recess of guide rail
35 coupling lever
35*a* counterstop of coupling lever
35*c* locking element of coupling lever
36 furniture carcass
37 item of furniture
38 abutment element of carrier
39 counterstop of guide rail
40 holding arm of guiding device
41 fitting portion of guiding device
42*a*, 42*b* fastening locations of guiding device
43 cavities of the guide rail
44 pivoting axis of fitting portion
45 crossing region
46 spreading device
47 mounting portion
48 axis
49 spreading lever
50 spring element
51 bearing bolt
52 bore
53 second drive device
54 fitting portion
55 axis
56 adjustment device
57 adjusting screw
58 abutment element
59 spring device
60 housing portion
61 roller
62 axis
63 intermediate piece
64 axis
65 axis
66 control curve
67 actuating arm
68 adjustment wheel
69 fastening means
70 fastening location

The invention claimed is:

1. A guide system for guiding a movably-supported first furniture part hingedly connected to a second furniture part, the guide system comprising:

a first guide rail for guiding the first furniture part and the second furniture part, a second guide rail for guiding the first furniture part and the second furniture part, wherein the second guide rail extends transversely relative to the first guide rail, a guiding device to be connected to the first furniture part, the guiding device being movable relative to the first guide rail and the second guide rail, and having a first fitting portion for fastening the guiding device to the first furniture part, a carrier displaceable relative to the second guide rail and connected to a second fitting portion for fastening the carrier to the second furniture part, a first drive device for moving the guiding device, starting from the second guide rail, in a direction towards the first guide rail, and a second drive device for moving the guiding device, starting from the first guide rail, into a position in which the first fitting portion and the second fitting portion are aligned such that the first furniture part and the second furniture part to be connected to the first fitting portion and the second fitting portion are aligned coplanar to each other, wherein the first drive device includes an entrainment member configured to be pressurized by a force storage member, and the carrier is configured to be driven by the entrainment member in a direction extending transversely to the longitudinal direction of the first guide rail, and wherein the entrainment member is further configured to be releasably coupled to the guiding device, the entrainment member being locked in a parking position and configured to be unlocked by an entering movement of the guiding device starting from a crossing region in a top view onto the first guide rail and the second guide rail in the mounting position so that the entrainment member, together with the guiding device coupled therewith, can be retracted along the second guide rail by a force of the force storage member.

2. A guide system for guiding a movably-supported first furniture part hingedly connected to a second furniture part, the guide system comprising:

a first guide rail for guiding the first furniture part and the second furniture part, a second guide rail for guiding the first furniture part and the second furniture part, wherein the second guide rail extends transversely relative to the first guide rail, a guiding device to be connected to the first furniture part, the guiding device being movable relative to the first guide rail and the second guide rail, and having a first fitting portion for fastening the guiding device to the first furniture part, a carrier displaceable relative to the second guide rail and connected to a second fitting portion for fastening the carrier to the second furniture part, a first drive device for moving the guiding device, starting from the second guide rail, in a direction towards the first guide rail, and a second drive device for moving the guiding device, starting from the first guide rail, into a position in which the first fitting portion and the second fitting portion are aligned such that the first furniture part and the second furniture part to be connected to the first fitting portion and the second fitting portion are aligned coplanar to each other, wherein the first drive device includes an entrainment member configured to be pressurized by a force storage member, and the carrier is configured to be driven by the entrainment member in a direction extending transversely to the longitudinal direction of the first guide rail, wherein the entrainment member includes a pivotally mounted pressure roller configured to run along a control curve, wherein the control curve includes a retraction section for at least partially retracting the carrier along the second guide rail, and a tensioning section adjoining the retraction section for loading the force storage member, and wherein the first drive device includes a movably mounted switch member with a setting contour arranged or formed thereon, and the pressure roller is configured to run along the setting contour of the switch member upon a movement of the carrier in a direction towards the first guide rail, so that the retraction section of the control curve can be bypassed by the pressure roller.

3. A guide system for guiding a movably-supported first furniture part hingedly connected to a second furniture part, the guide system comprising:

a first guide rail for guiding the first furniture part and the second furniture part, a second guide rail for guiding the first furniture part and the second furniture part, wherein the second guide rail extends transversely relative to the first guide rail, a guiding device to be connected to the first furniture part, the guiding device being movable relative to the first guide rail and the second guide rail, and having a first fitting portion for fastening the guiding device to the first furniture part, a carrier displaceable relative to the second guide rail and connected to a second fitting portion for fastening the carrier to the second furniture part, a first drive device for moving the guiding device, starting from the second guide rail, in a direction towards the first guide rail, a second drive device for moving the guiding device, starting from the first guide rail, into a position in which the first fitting portion and the second fitting portion are aligned such that the first furniture part and the second furniture part to be connected to the first fitting portion and the second fitting portion are aligned coplanar to each other, and a spreading device configured to spread apart the first furniture part and the second furniture part connected to the first fitting portion and the second fitting portion from a parallel position to one another into an angled position to one another, wherein the spreading device includes a mounting portion to be fixed to one of the first furniture part and the second furniture part, the mounting portion having a spreading lever pressurized by a spring element for spreading apart the furniture parts.

4. A guide system for guiding a movably-supported first furniture part hingedly connected to a second furniture part, the guide system comprising:

a first guide rail for guiding the first furniture part and the second furniture part, a second guide rail for guiding the first furniture part and the second furniture part, wherein the second guide rail extends transversely relative to the first guide rail, a guiding device to be connected to the first furniture part, the guiding device being movable relative to the first guide rail and the second guide rail, and having a first fitting portion for fastening the guiding device to the first furniture part, a carrier displaceable relative to the second guide rail and connected to a second fitting portion for fastening the carrier to the second furniture part, a first drive device for moving the guiding device, starting from the second guide rail, in a direction towards the first guide rail, and a second drive device for moving the guiding device, starting from the first guide rail, into a position in which the first fitting portion and the second fitting portion are aligned such that the first furniture part and the second furniture part to be connected to the first fitting portion and the second fitting portion are aligned coplanar to each other, wherein the second drive device is mounted on a column extending vertically in the mounting position, wherein the column is connected to the carrier and is movably mounted, together with the carrier, in a direction extending transversely to the longitudinal direction of the first guide rail, wherein the second drive device includes an actuating arm connected to the second fitting portion, a spring device for applying a force to the actuating arm, a control curve, and a roller pressurized by the spring device, wherein the roller is configured to run along the control curve upon a movement of the actuating arm.

5. The guide system according to claim 4, wherein the control curve is on an intermediate piece, the second fitting portion to be fixed to the second furniture part is hingedly connected to a third fitting portion by the intermediate piece, wherein the third fitting portion is configured to be fixed to the column.

6. The guide system according to claim 1, wherein the carrier is configured to be moved into a transfer position in which the carrier adjoins the first guide rail in the longitudinal direction, so that the guiding device can be transferred to and from between the first guide rail and the carrier.

7. An arrangement comprising:

a first furniture part;

a second furniture part hingedly connected to the first furniture part by a pivoting axis, and the guide system according to claim 1 for guiding the furniture parts.

8. An item of furniture comprising the arrangement according to claim 7.

9. The item of furniture according to claim 8, wherein the item of furniture includes a furniture carcass being stationary during operation, and at least two furniture parts movably supported relative to the furniture carcass, wherein the at least two furniture parts are hingedly connected to one another by a pivoting axis extending vertically in the mounted position, wherein the at least two furniture parts can be moved by the guide system between a first position, in which the furniture parts are aligned substantially parallel to one another, and a second position, in which the furniture parts are aligned substantially coplanar to one another.

10. The guide system according to claim 1, wherein each of the first drive device and the second drive device is a mechanical drive device configured to move the first furniture part and the second furniture part by mechanical operation without any electrical components.

* * * * *